US007565090B2

(12) United States Patent
Kamimura

(10) Patent No.: US 7,565,090 B2
(45) Date of Patent: Jul. 21, 2009

(54) METHOD OF REFILLING DEVELOPER CARTRIDGE, DEVELOPER CARTRIDGE, AND IMAGE FORMING APPARATUS

(75) Inventor: Naoya Kamimura, Nagoya (JP)

(73) Assignee: Brother Kogyo Kabushiki Kaisha (JP)

( * ) Notice: Subject to any disclaimer, the term of this patent is extended or adjusted under 35 U.S.C. 154(b) by 425 days.

(21) Appl. No.: 11/362,842

(22) Filed: Feb. 28, 2006

(65) Prior Publication Data

US 2006/0198658 A1 Sep. 7, 2006

(30) Foreign Application Priority Data

Mar. 1, 2005 (JP) ..... 2005-056013

(51) Int. Cl.
*G03G 15/00* (2006.01)

(52) U.S. Cl. ..... 399/109; 399/12

(58) Field of Classification Search ..... 399/109, 399/12

See application file for complete search history.

(56) References Cited

U.S. PATENT DOCUMENTS 4,523,615 A * 6/1985 Feenstra et al.
5,913,092 A * 6/1999 Bisaiji et al.
6,366,742 B1 * 4/2002 Reihl et al. ..... 399/12
6,535,697 B2 * 3/2003 Reihl et al. ..... 399/12
6,859,634 B2 * 2/2005 Itoh et al.
6,889,026 B2 * 5/2005 Schlageter et al.
7,139,505 B2 * 11/2006 Askren et al.
7,352,982 B2 * 4/2008 Mori ..... 399/109
2002/0110379 A1 * 8/2002 Reihl et al. ..... 399/12
2003/0031490 A1 * 2/2003 Takahashi
2003/0184624 A1 * 10/2003 Kinalski
2004/0179866 A1 * 9/2004 Muramatsu et al.
2005/0111858 A1 * 5/2005 Nakazato ..... 399/12
2006/0132555 A1 * 6/2006 Uehara et al.

FOREIGN PATENT DOCUMENTS

JP 09236983 A * 9/1997
JP 2004054243 2/2004
JP 2004184442 7/2004

* cited by examiner

*Primary Examiner*—Susan S Lee
(74) *Attorney, Agent, or Firm*—Banner & Witcoff, Ltd.

(57) ABSTRACT

In a method of refilling a developer cartridge, a container that contains an original developer manufactured by a polymerization method is prepared. A new developer manufactured by the polymerization method is refilled in the container without cleaning an inside of the container. The new developer includes the same color as the original developer or a color darker than the color of the original developer.

11 Claims, 12 Drawing Sheets

METHOD OF REFILLING DEVELOPER CARTRIDGE, DEVELOPER CARTRIDGE, AND IMAGE FORMING APPARATUS

CROSS-REFERENCE TO RELATED APPLICATION

This application is based on and claims the benefit of priority from the prior Japanese Patent Application No. 2005-56013, filed on Mar. 1, 2005; the entire contents of which are incorporated herein by reference.

TECHNICAL FIELD

The present invention relates to a method of refilling a developer cartridge used for a laser printer or the like, a developer cartridge, and an image forming apparatus, such as a laser printer or the like.

BACKGROUND

Generally, in an electrophotographic image forming apparatus, such as a laser printer or the like, a developer cartridge filled with a toner is mounted so as to be freely attached to or detached from it.

In such a developer cartridge, a filling chamber and a developing chamber are formed. In the filling chamber, a toner is filled, and a rotationally driven agitator is provided. In addition, in the developing chamber, a feeder roller, a developer roller, and a layer pressure regulating plate are provided. The feeder roller and the developer roller are disposed opposite to each other such that they come into contact with each other, and the layer pressure regulating plate contacts a surface of the developer roller with pressure.

In addition, the developer cartridge is mounted in the laser printer. If a power output from the laser printer is input to the developer cartridge though a gear connection or the like, the agitator is driven to rotate, so that the toner filled in the filling chamber is carried to the developing chamber. Then, in the developing chamber, the toner is supplied to the developer roller by the rotation of the feeder roller. At this time, the toner is subjected to frictional charging between the feeder roller and the developer roller. Further, when the developer roller rotates, the toner loaded on the surface of the developer roller enters between the layer pressure regulating plate and the developer roller and then carried on the surface of the developer roller that is a thin layer having a predetermined thickness.

In addition, in the laser printer, the developer cartridge is disposed such that the developer roller and the photosensitive drum are opposite to each other. When the toner, which has been carried on the surface of the developer roller that is the thin layer, is opposite to the photosensitive drum, the toner develops an electrostatic latent image so as to form a visible image. Then, the visible image is transferred to the paper by the rotation roller, and thus a predetermined image is formed on the paper.

Further, as described above, the developer cartridge is mounted on the laser printer, so that the toner accommodated in the filling chamber is consumed. In addition, when the toner is empty, the laser printer displays a message indicating that the toner is empty so as to advise a user to exchange the used developer cartridge with a new developer cartridge. Therefore, the user removes the used developer cartridge from the printer, and mounts a new developer cartridge in the printer.

However, in recent years, in the exchange of this developer cartridge, generally, the used developer cartridge is not discarded in view of recycling, but a new toner is refilled in the used developer cartridge so as to be reused.

For example, a technology about a determining device and a determining method is disclosed in JP-A-2004-054243. Specifically, according to the technology disclosed in JP-A-2004-054243, a toner color of a toner cartridge, a year, month, and date when the toner cartridge is manufactured, the number of printed paper, and the number of reused toner cartridge are read out from a storing element provided in the toner cartridge (developer cartridge). Then, using a condition value corresponding to the read toner color, the determining device determines whether the toner cartridge is reused or not reused. In addition, a color of the filled toners determined when it is determined that the corresponding toner cartridge can reused, so that it can be easily determined whether the toner cartridge can be reused and the effective utilization of the toner cartridge can be achieved.

As such, by determining whether the toner cartridge can be reused by the determining element, problems can be solved, in which the difference is generated between determining references of people and a time or effort is required for performing the determination.

SUMMARY

However, according to the technology disclosed in JP-A-2004-054243, since it is not possible to accurately measure an amount of a residual toner in the toner cartridge, it is necessary that the cartridge be cleaned until the residual toner in the toner cartridge is completely removed, and then a new toner be refilled. As a result, much time or effort is required, which results in a cost increase.

Accordingly, the invention has been made to solve the above-mentioned problems and provides a method of refilling a developer cartridge capable of simply refilling a toner and forming an excellent image at the time of using a developer cartridge again, a developer cartridge, and an image forming apparatus.

According to an aspect of the invention, in a method of refilling a developer cartridge, a container that contains an original developer manufactured by a polymerization method is prepared. A new developer manufactured by the polymerization method is refilled in the container without cleaning an inside of the container. The new developer comprises the same color as the original developer or a color darker than the color of the original developer.

According to another aspect of the invention, in a method of refilling a developer cartridge, a residual developer is extracted from a container that contains a developer. A weight of the residual developer in the container is measured on the basis of a weight of a developer cartridge obtained after extracting the residual developer. Whether a value of the measured weight of the residual developer is not more than a predetermined value is determined. When it is determined that the value is not more than the predetermined value, a new developer is refilled. The new developer comprises the same color as the original developer or a color darker than the color of the original developer in the container.

According to another aspect of the invention, in a method of refilling a developer cartridge, a weight of a residual developer in a container is measured on the basis of a weight of a developer cartridge that contains a developer. Whether a value of the measured weight of the residual developer is not more than a predetermined value is determined. When it is determined that the value is not more than the predetermined value, a new developer is refilled. The new developer comprises the same color as the original developer or a color darker than the color of the original developer in the container.

According to another aspect of the invention, a developer cartridge comprises: a container in which a developer manufactured by a polymerization method is contained; and a rib comprising the same shape as a main body of an image forming apparatus contained in the container. A new developer manufactured by a polymerization method is refilled in the container when an amount of developer is not more than a predetermined value. The new developer comprises the same color as an original developer or a color darker than the color of the original developer. A number of the rib varies in accordance with a color of the developer refilled in the container.

According to another aspect of the invention, an image forming apparatus comprises: a frame that comprises the plurality of developer cartridges according to claim 10 provided so as to be attached to or detached from the frame; and a groove being provided in the frame. The grooves correspond to the rib respectively provided in the container of the plurality of developer cartridges.

BRIEF DESCRIPTION OF THE DRAWINGS

These and other objects and advantages of this invention will become more fully apparent from the following detailed description taken with the accompanying drawings in which.

DESCRIPTION OF THE ILLUSTRATIVE ASPECTS

[An Illustrative Aspect]

(Entire Structure)

Figure 1:
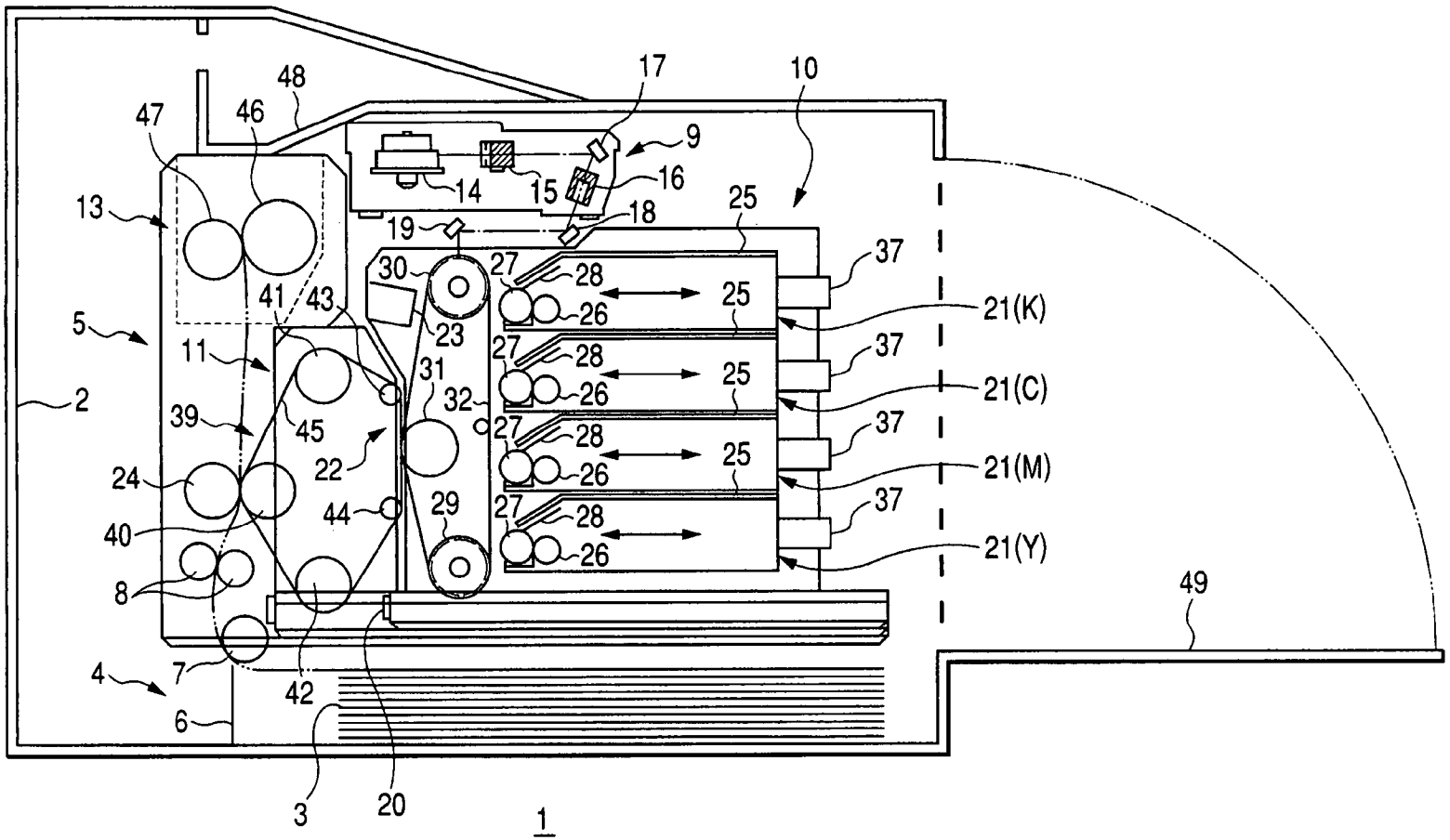
FIG. 1 is a lateral cross-sectional view illustrating a main portion of a color laser printer 1 according to an illustrative aspect.
Figure 2A:
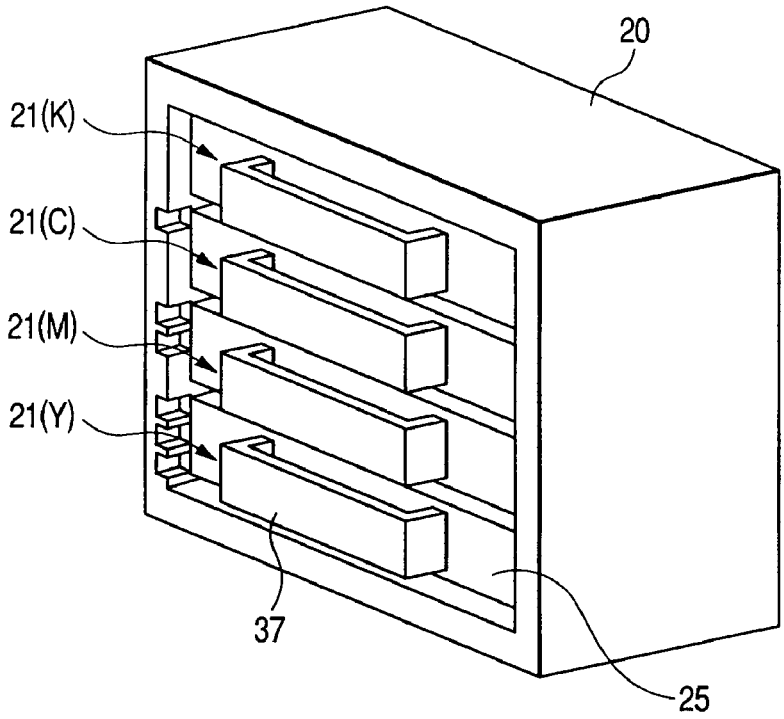
FIG. 2A a perspective view illustrating a process accommodating member 20 serving as a frame included in a color laser printer 1 and a developer cartridge 21 accommodated in the process accommodating member 20.
Figure 2B:
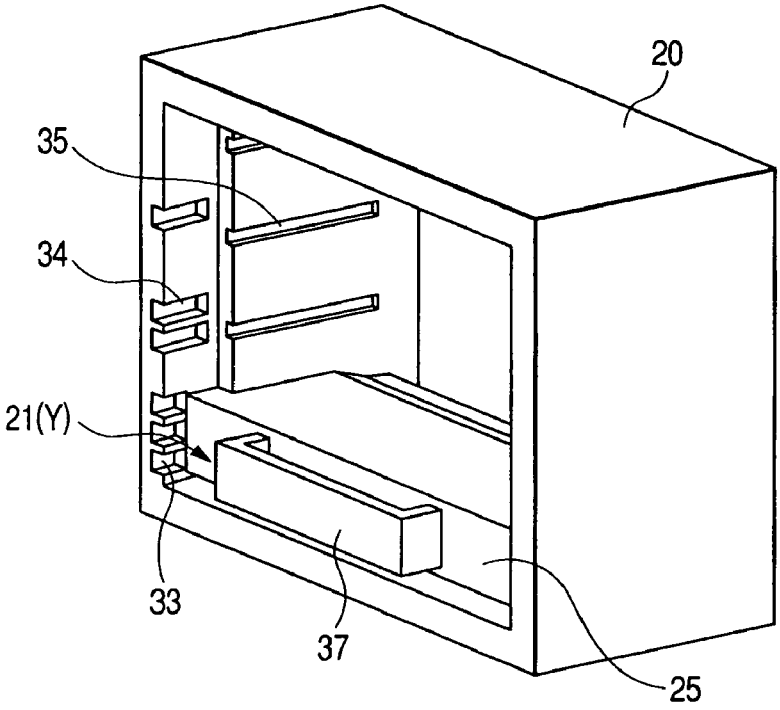
FIG. 2B is a perspective view illustrating a state in which a plurality of developer cartridges 21 are removed from a process accommodating member 20.
Figure 3A:
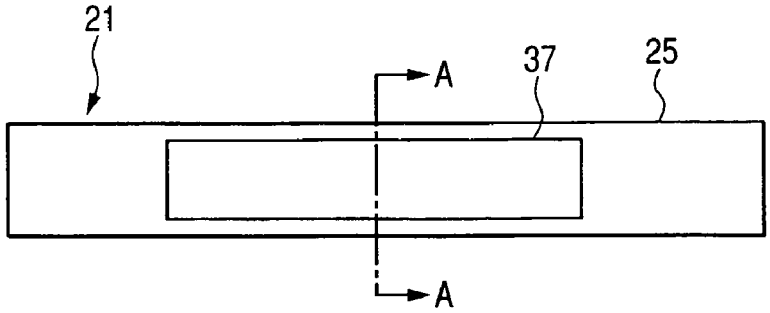
FIG. 3A is a front view illustrating a single developer cartridge 21 as viewed from the front.
Figure 3B:
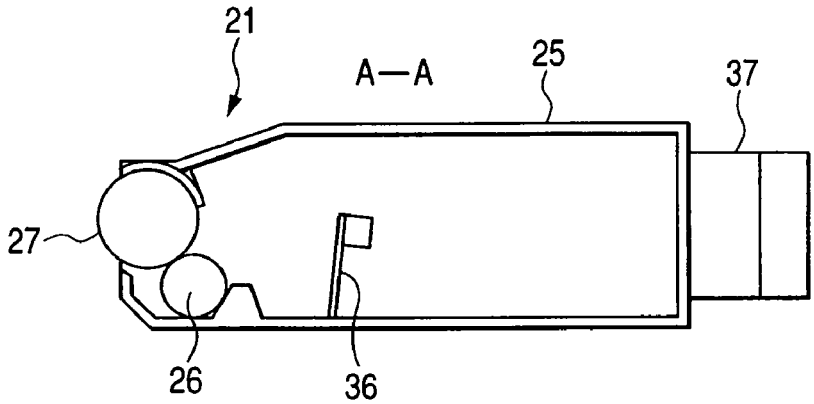
FIG. 3B is a cross-sectional view illustrating a state taken along the line A-A of a developer cartridge 21 shown in FIG. 3A.
Figure 4:
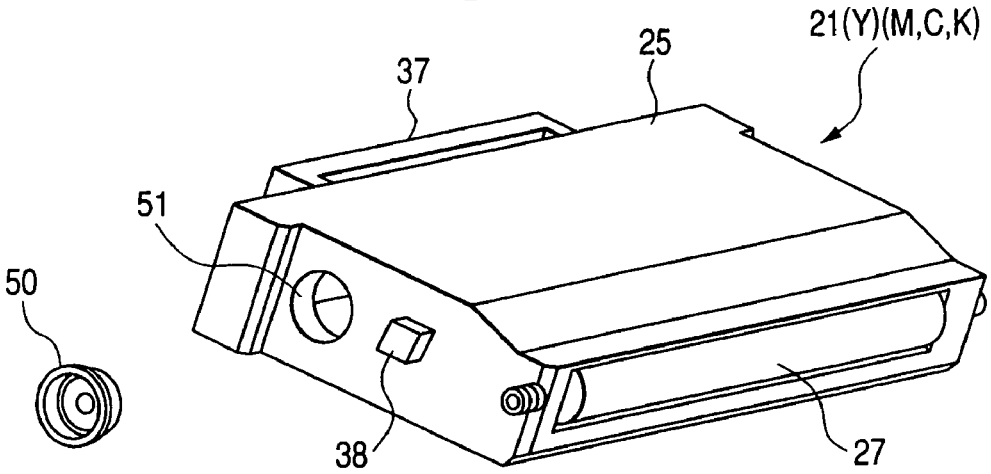
FIG. 4 is a perspective view illustrating a developer cartridge 21(Y) (M, C, and K) having a toner filling hole 51 for filling a toner.

First, an entire structure of a color laser printer 1 according to an illustrative aspect will be described with reference to FIGS. 1 to 4. In this case, the color laser printer 1 is an image forming apparatus which includes four developer cartridges 21 (including a yellow developer cartridge 21(Y), a margent developer cartridge 21(M), a cyan developer cartridge 21(C), and a black developer cartridge 21(K)) that are developer cartridges in which toners of four colors serving as a developer are respectively filled. FIG. 1 is a lateral cross-sectional view illustrating a main portion of the color laser printer 1 according to an illustrative aspect. In FIG. 1, the color laser printer 1 has a feeder unit 4 that feeds paper 3 to the inside of a main body casing 2, an image forming unit 5 that forms a predetermined image on the fed paper 3, or the like. FIG. 2A is a perspective view illustrating a process accommodating member 20 serving as a frame included in the color laser printer 1 and developer cartridges 21 accommodated in the process accommodating member 20, and FIG. 2B is a perspective view illustrating a state in which the plurality of developer cartridges 21 are removed from the process accommodating member 20. FIG. 3A is a front view illustrating a single developer cartridge 21 as viewed from the front (in the below description, the right side in FIG. 1 is referred to as the front, and the left side therein is referred to as the rear), and FIG. 3B is a cross-sectional view illustrating a state taken along the line A-A of the developer cartridge 21 shown in FIG. 3A. FIG. 4 is a perspective view illustrating a developer cartridge 21(Y) (M, C, and K) having a toner filling hole 51 for filling a toner.

In addition, the main body casing 2 is provided with an opening and closing cover 49 that opens the front. The opening and closing cover 49 is provided on the front wall of the main body casing 2. At this time, the opening and closing cover 49 is provided in a such a manner that it can be freely opened and closed at a location where an upper portion of the opening and closing cover 49 closes the front wall of the main body casing 2 in a state in which a lower end portion of the opening and closing cover 49 is used as a rotational axis, and at a location where the upper portion of the main body casing 2 is turned from the closing location and is then opened up to a substantially horizontal direction.

<Structure of Feeder Unit>.

The feeder unit 4 includes a feeder cassette 6, a feeder roller 7, and a resist roller 8. The feeder cassette 6 accommodates the paper 3 in a laminated shape. The feeder cassette 6 is mounted on a lower portion of the main body casing 2 so as to be freely attached to or detached from it, and it is provided such that it can be removed toward the front of a horizontal direction. The feeder roller 7 is supported on an upper side of the rear of the feeder cassette 6 such that it can freely rotate in the main body casing 2. In addition, the resist roller 8 has a pair of driving roller and driven roller, and it is supported above the feeder roller 7 such that it can freely rotate in the main body casing 2.

<Structure of Image Forming Unit>

An image forming unit 5 includes a scanner unit 9, a process unit 10, an intermediate transfer unit 11, a transfer roller 24, a fixing unit 13, or the like. Hereinafter, the respective constituent elements will be described in detail.

<Structure of Scanner Unit>

The scanner unit 9 is fixed on an upper side of the main body casing 2 in the main body casing 2, and includes a laser emitting unit (not shown), a polygon mirror 14, a plurality of lenses 15 and 16, and a plurality of reflective mirrors 17, 18, and 19. In addition, in the scanner unit 9, a laser beam is transmitted through or reflected on the polygon mirror 14, the lens 15, the reflective mirror 17, the lens 16, and the reflective mirrors 18 and 19 on the basis of predetermined image data emitted from the laser emitting unit, and then irradiated onto a surface of a photosensitive belt 32 of a photosensitive belt mechanism 22 (which will be described in detail below) by performing high-speed scanning.

<Structure of Process Unit>

The process unit 10 includes a process accommodating member 20, four developer cartridges 21(Y), 21(M), 21(C), and 21(K), a photosensitive belt mechanism 22, a scorotron-type charger 23, or the like. Further, in the illustrative aspect, the four developer cartridges 21 have been described by using the four-color laser printer. However, the illustrative aspect is not limited thereto, and six developer cartridges 21 may be used as in a six-color laser printer, and the number of the developer cartridges 21 may be changed.

The process accommodating member 20 is provided at an upper side of the feeder cassette 6 so as to be freely attached to or detached from the main body casing 2. In addition, the process accommodating member 20 mounts the plurality of developer cartridges 21 and the photosensitive belt mechanism 22 thereon so that they can be freely attached to or from the process accommodating member 20, and supports the scorotron-type charger 23 to be fixed thereon.

The four developer cartridges 21 includes a yellow developer cartridge 21(Y) in which a toner serving as a yellow developer is accommodated, a magenta developer cartridge 21(M) in which a toner serving as a magenta developer is accommodated, a cyan developer cartridge 21(C) in which a toner serving as a cyan developer is accommodated, and a black developer cartridge 21(K) in which a toner serving as a black developer is accommodated. Above the process accommodating member 20, the yellow developer cartridge 21(Y), the magenta developer cartridge 21(M), the cyan developer cartridge 21(C), and the black developer cartridge 21(K) are sequentially disposed upward at a predetermined gap in a vertical direction. In each of the four developer cartridges 21, a protruding portion 37 protruding toward the front is formed.

In addition, as shown in FIGS. 1, 2A and 2B, each of the respective developer cartridges 21 is constructed such that it can be removed from the process accommodating member 20 toward the front of a horizontal direction in a state in which the opening and closing cover 49 is opened. As shown in FIGS. 2A, 2B and 4, each of the four developer cartridges 21 is freely attached to or detached from the process accommodating member 20 in a horizontal direction by projecting portions 38 provided on both sides of each of the developer cartridges (only one side is shown in the drawing) and each of process accommodating guides 35. In this case, the process accommodating guide 35 is provided on an inner side of the process accommodating member 20, and guide the projecting portions 38 and supports each developer cartridge 21 such that it can slide on the process accommodating member 20.

Each of the four developer cartridges 21 includes a toner accommodating unit 25 serving as a container, a feeder roller 26, a developer roller 27, a layer pressure regulating plate 28, a rib 33 serving as a display unit, or the like (see FIGS. 1 to 3).

As shown in FIG. 2B, the rib 33 is provided on a left side surface when the developer cartridge 21 is viewed from the front. Specifically, three ribs 33 are provided in the yellow developer cartridge 21(Y), two ribs 33 are provided in the magenta developer cartridge 21(M), one rib 33 is provided in the cyan developer cartridge 21(C), and no rib 33 is provided in the black developer cartridge 21(K). In addition, in the process accommodating member 20, three grooves 34 are formed in a portion where the yellow developer cartridge 21(Y) is accommodated, two grooves 34 are formed in a portion where the magenta developer cartridge 21(M) is accommodated, and one groove 34 is formed in a portion where the cyan developer cartridge 21(C) is accommodated, and the ribs 33 provided in the respective developer cartridges 21 are fitted to the grooves 34. In addition, the groove 34 is not formed in a portion of the process accommodating member 20 where the black developer cartridge 21(K) is accommodated.

Therefore, for example, even if a user erroneously mounts the magenta developer cartridge 21(M) where the two ribs 33 are provided on a portion where the cyan developer cartridge 21(C) in which one groove 34 is formed should be accommodated, since the number of the ribs 33 and the number of the grooves 34 are not equal to each other, the mounting cannot be made. For this reason, it is possible for a user to mount the developer cartridges 21 of the respective colors at predetermined locations of the process accommodating member 20 without a mistake.

The toner accommodated in the toner accommodating unit 25 is a positive-charge-type non-magnetic one-component developer, and has toner mother particles with an average diameter of 9 μm. The toner mother particles are obtained by adding to a styrene acrylic resin formed in a spherical shape by a suspension polymerization method known coloring agents, such as carbon black or the like, and charge controlling agents, such as nigrosine, triphenylmethane, quaternary ammonium salt, or the like, or a charge controlling resin. In addition, in the toner, silica serving as an external additive is added to the surface of the toner mother particle. In addition, the silica serving as the external additive is subjected to a known hydrophobic treatment using a silane coupling agent, a silicon oil or the like, and has an average diameter of 10 nm. An additive amount of the silica is 0.6 percent by weight with respect to the toner mother particle. The toners of the four colors including yellow, magenta, cyan, and black are contained in the respective developer cartridges 21(Y), 21(M), 21(C), and 21(K).

As such, the toner has an approximately spherical shape by the suspension polymerization method. In addition, since the toner has added by 0.6 percent by weight the silica which is subjected to a hydrophobic treatment, has an average diameter of 10 nm and serves as the external additive, the toner has the very superior fluidity. Therefore, the sufficient charged amount can be obtained by the friction charging. Further, since this toner does not have corner portion as in a pulverized toner, it is difficult to receive a mechanical force. In addition, the toner has an excellent electric field following capability and excellent transfer efficiency.

In addition, in the illustrative aspect, the polimerization toner manufactured by the suspension polymerization method has been used, but a polymerization toner manufactured by other polymerization method may be used. For example, examples of other polymerization method may include an emulsion polymerization method in which water is used as a medium, an emulsifying agent or surfactant is dissolved in the water, a monomer which is not soluble in the water or has low solubility with respect to the water is added to the water in which the emulsifying agent or surfactant is dissolved, and the polymerization is performed using an initiator which is soluble to the water (for example, kalium persulfate, hydrogen persulfate, etc.); a liquid polymerization method in which a monomer or initiator (for example, benzoyl persulfate, azobisisobutyronitrile, etc.) is dissolved in a solvent in which a produced polymer is soluble, and then it is heated so as to perform polymerization; a bulk polymerization method in which a solvent is not used, only a vinyl monomer is heated as it is or is heated after adding to it a small amount of initiator (for example, benzoyl persulfate, azobisisobutyronitrile, etc.), and the polymerization is performed; and a precipitation polymerization in which a monomer and an initiator (for example, benzoyl persulfate, azobisisobutyronitrile, etc.) are soluble, a produced polymer is not solved, a solvent which is difficult to swell is used, and the solvent is heated so as to perform the polymerization.

In addition, the toner accommodated in the toner accommodating unit 25 is discharged to a feeder roller 26, which will be described in detail below, by gaiters of an agitator 36 (see FIG. 3) provided in the toner accommodating unit 25.

The feeder roller 26 is rotatably disposed on the rear side in the toner accommodating unit 25, and the developer roller 27 is rotatably disposed on the rear side of the feeder roller 26. In the feeder roller 26, a metallic roller shaft is covered with a roller made of a conductive sponge member. In addition, in the developer roller 27, a metallic roller shaft is covered with a roller made of a conductive sponge member. More particularly, the roller of the developer roller 27 has a two-layered structure in which an elastic roller portion and a coating layer are laminated. In this case, the elastic roller portion is made of a conductive urethane rubber containing carbon minute particles or the like, a silicon rubber, an EPDM rubber, or the like, and the coating layer has as ingredient components a urethane rubber, a urethane resin, a polyimide resin, or the like, which are covered on a surface of the roller portion. In addition, a predetermined development bias is applied to the development roller 27. Moreover, the feeder roller 26 and the development roller 27 come into contact with each other in a compressed state to a certain degree.

In addition, the layer pressure regulating plate 28 is provided on the developer roller 27. The layer pressure regulating plate 28 has a pushing portion which is made of an insulating silicon rubber and has a spherical shape in its cross section. This pushing portion is provided at a front end portion of a plate body made of a metallic plate spring member. In addition, in the layer pressure regulating plate 28, one end portion of the plate body is supported on the developer cartridge 21 at the upper side of the developer roller 27, and the pushing portion is disposed opposite to the developer roller 27 such that the pushing portion contacts the top surface of the developer roller 27 with pressure by an elastic force of the plate body.

In addition, the toner discharged from the toner accommodating unit 25 is supplied to the developer roller 27 by the rotation of the feeder roller 26. At this time, the toner is subjected to positive friction charging between the feeder roller 26 and the developer roller 27. Further, when the developer roller 27 rotates, the toner, which is supplied to the top surface of the developer roller 27, enters between the pushing portion of the layer pressure regulating plate 28 and the developer roller 27. Then, the toner is sufficiently subjected to the friction charging between the pushing portion of the layer pressure regulating plate 28 and the developer roller 27, and then carried on the developer roller 27 as a thin layer having a predetermined thickness.

<Structure of Photosensitive Belt Mechanism>

The photosensitive belt mechanism 22 is disposed opposite to the rear sides of the four developer cartridges 21. The photosensitive belt mechanism 22 includes a first photosensitive belt roller 29 that is disposed opposite to the yellow developer cartridge 21(Y) located at the bottom, a second photosensitive belt roller 30 that is disposed opposite to the black developer cartridge 21(K) located at the top above the first photosensitive belt roller 29 in a vertical direction, a third photosensitive belt roller 31 that is disposed below the slant rear side of the second photosensitive belt roller 30 above the slant rear side of the first photosensitive belt roller 29, and a photosensitive roller 32 that is wound around the first to third photosensitive roller belts 29 to 31.

The first to third photosensitive belt rollers 29 to 31 are disposed in an approximately longitudinal triangular shape in the process accommodating member 20, and the photosensitive belt 32 is wound around the first to third photosensitive belt rollers 29 to 31. In addition, the photosensitive belt 32 is composed of an endless belt which is made of a conductive polycarbonate or polyimide in which a conductive particle, such as carbon or the like, is dispersed, and an organic photosensitive layer is provided on the surface of the photosensitive belt 32.

In addition, by a power transmitted from a motor (not shown), the third photosensitive belt roller 31 starts to rotate, the first photosensitive belt roller 29 and the second photosensitive belt roller 30 are driven, and the photosensitive belt 32 rotates in a counterclockwise direction between the first to third photosensitive belt rollers 29 to 31.

<Structure of Scorotron-Type Charger>

The scorotron-type charger 23 is fixed on the backside upper end portion of the process accommodating member 20 so as to be supported thereto. The scorotron-type charger 23 is disposed at a predetermined gap such that it does not come into contact with the photosensitive belt 32 between the second photosensitive belt roller 30 and the third photosensitive belt roller 31 at the rear of the photosensitive belt mechanism 22. This scorotron-type charger 23 is a positive charging scorotron-type charger that generates a corona discharge from a charging wire, such as tungsten or the like, and it is constructed so as to positively charge the surface of the photosensitive belt 32 uniformly.

<Structure of Intermediate Transfer Unit>

The intermediate transfer unit 11 includes an intermediate transfer belt mechanism 39 or the like.

In addition, the intermediate transfer belt mechanism 39 is disposed in the back of the photosensitive belt mechanism 22. The intermediate transfer belt 39 includes a first intermediate transfer belt roller 40 that is disposed opposite to a transfer roller 24 (which will be described in detail below), a second intermediate transfer belt roller 41 that is disposed at an upper side of the slant front of the first intermediate transfer belt roller 40, a third intermediate transfer belt roller 42 that is disposed at a lower side of the slant front of the first intermediate transfer belt roller 40 below the second intermediate transfer belt roller 41 in the vertical direction, two tension rollers 43 and 44 that are respectively disposed at a predetermined gap in front of the second intermediate transfer belt roller 41 and the third intermediate transfer belt roller 42, and an intermediate transfer belt 45 that is an endless belt which is wound around the first to third intermediate transfer belts 40 to 42 and the two tension rollers 43 and 44 and made of a resin such as a conductive polycarbonate or polyimide in which a conductive particle, such as carbon or the like, is dispersed.

The first to third intermediate transfer belt rollers 40 to 42 and the two tension rollers 43 and 44 is disposed in an approximately pentagonal shape. The intermediate transfer belt 45 is wound around the first to third intermediate transfer belt rollers 40 to 42 and the two tension rollers 43 and 44. In this state, the intermediate transfer belt 45 is disposed opposite to the first photosensitive belt roller 29 with the photosensitive roller 32 interposed therebetween such that the intermediate transfer belt 45 comes into contact with the photosensitive belt 32 between the two tension rollers 43 and 44.

In addition, by a power transmitted from a motor (not shown), the first intermediate transfer belt roller 40 starts to rotate, the second intermediate transfer belt roller 41, the third transfer belt roller 42, and the two tension roller 43 and 44 are driven, and the intermediate transfer belt 45 rotates in a clockwise direction between the first to third intermediate transfer belt rollers 40 to 42, and the two tension rollers 43 and 44.

<Structure of Transfer Roller>

The transfer roller 24 is rotatably supported on the main body casing 2 in the back of the intermediate transfer belt mechanism 39, and the transfer roller 24 is disposed opposite to the first intermediate transfer belt roller 40 and the intermediate transfer belt 45 such that it comes into contact with the intermediate transfer belt 45. A predetermined transfer bias is applied to the intermediate transfer belt 45.

<Structure of Fixing Portion>

The fixing portion 13 is fixed at the upper side in the main body casing 2, and disposed above the intermediate transfer belt mechanism 39. The fixing portion 13 includes a heating roller 46 and a pushing roller 47 that pushes on the heating roller 46. The heating roller 46 has a metallic heating halogen lamp. The heating roller 46 makes color images transferred to the paper 3 by the transfer roller 24 subjected to the thermal fixation when the paper 3 passes between the heating roller 46 and the pushing roller 47.

(Example of Image Forming Operation)

In the above-mentioned laser printer 1 according to the illustrative aspect, the operation at the time of printing will be described with reference to FIG. 1.

In a state in which the feeder cassette 6 is mounted, the paper 3, which exists at the highest position of the feeder cassette 6, is supplied one-by-one when the feeder roller 7 rotates. Next, the paper is subjected to a predetermined resist process by the resist roller 8, and then carried to the image forming unit 5.

In the meantime, after the surface of the photosensitive belt 32 is positively charged uniformly by scorotron-type charger 23, the surface of the photosensitive belt 32 is exposed through high-speed scanning of a laser beam emitted from the scanner unit 9. Then, an electrostatic latent image is formed on the basis of predetermined image data.

Next, by a driving mechanism (not shown) for making the developer cartridge 21 move forward and backward, the developer roller 27 of a specific developer cartridge 21 selectively comes into contact with the photosensitive belt 32 where the electrostatic latent image is formed, monochrome visible images, which is accommodated in the specific developer cartridge 21, are formed on the photosensitive belt 32. Next, when the monochrome visible images formed on the photosensitive belt 32 are opposite to the intermediate transfer belt 45, the monochrome visible images sequentially overlap on the intermediate transfer belt 45. Thereby, a color image is formed on the intermediate transfer belt 45. In addition, the color image formed on the intermediate transfer belt 45 is collectively transferred to the paper 3 when the paper 3 passes between the intermediate transfer belt 45 and the transfer roller 24. The paper 3, to which the color image has been transferred between the intermediate transfer belt 45 and the transfer roller 24, is carried to the fixing unit 13, and the color image is thermally fixed on the paper 3. The paper 3, to which the color image is thermally fixed in the fixing unit 13, is discharged to a discharge tray 48 which is formed at an upper side of the main body casing 2.

Figure 5:
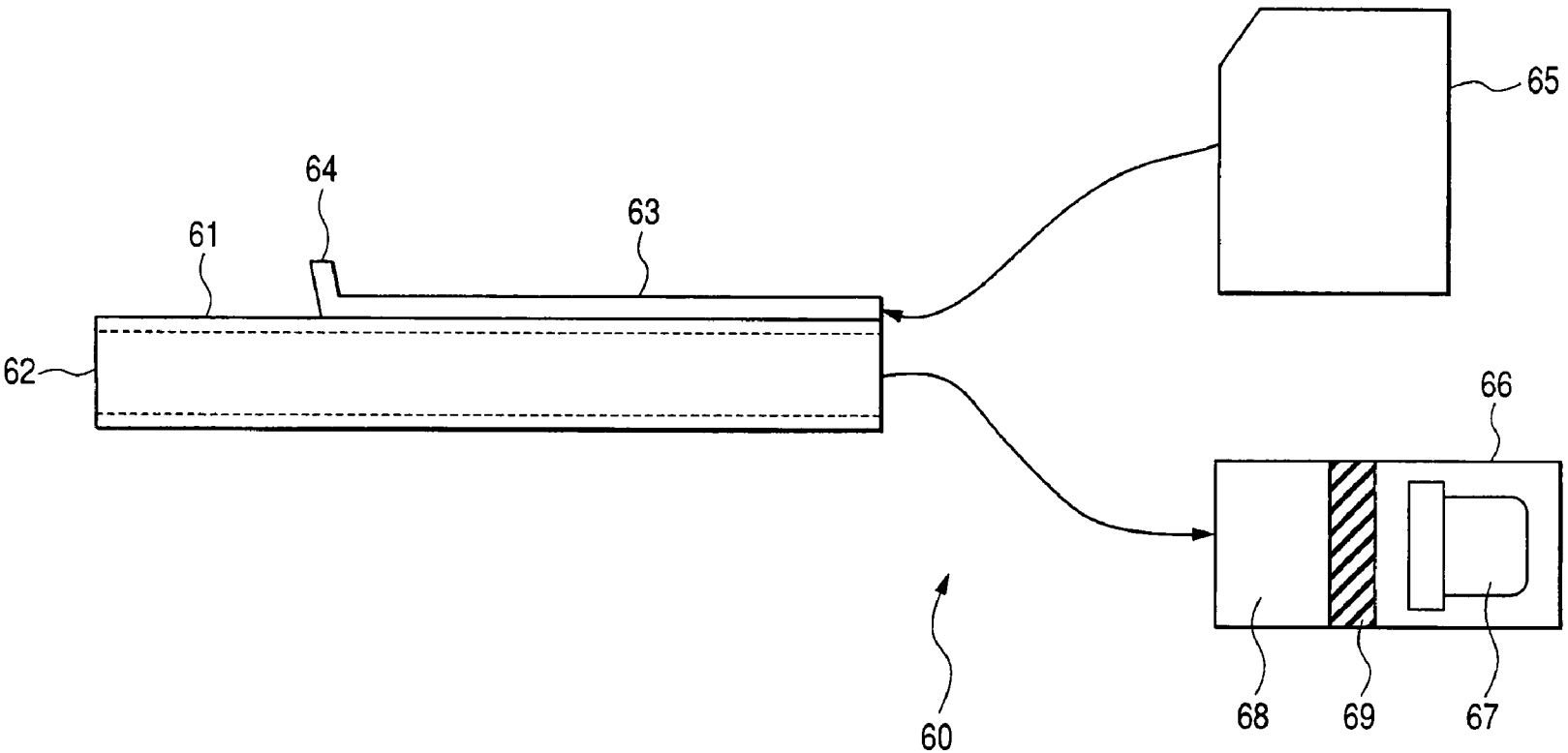
FIG. 5 is a conceptual diagram illustrating a toner extraction mechanism 60 for extracting a residual toner in a toner accommodating unit 25 of a developer cartridge 21(Y) (M, C, and K) in the illustrative aspect.
Figure 6:
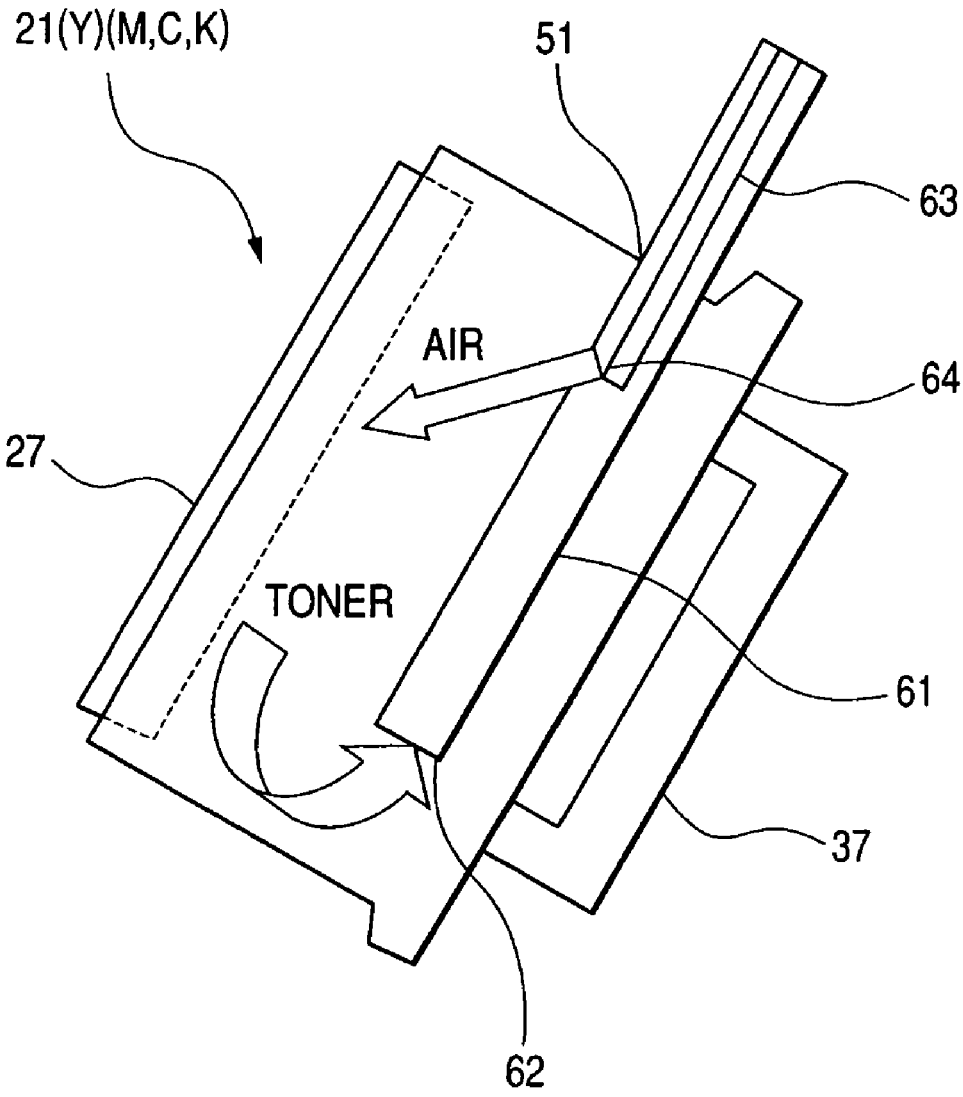
FIG. 6 is a conceptual diagram illustrating an extraction structure of a residual toner accommodated in a toner accommodating unit 25 of a developer cartridge 21(Y) (M, C, and K) by a toner extraction mechanism 60 in the illustrative aspect.
Figure 7:
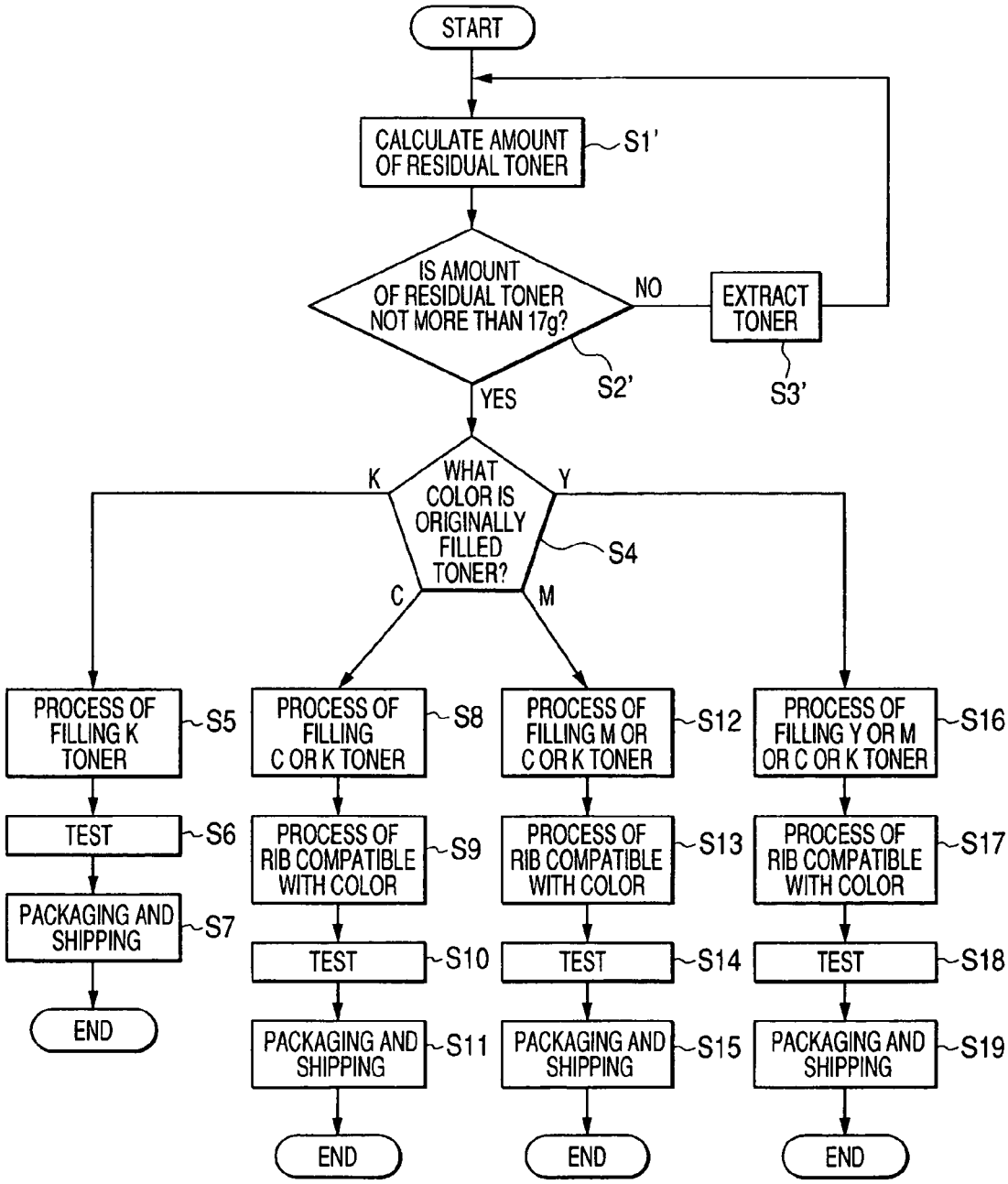
FIG. 7 is a flowchart illustrating a process of refilling a developer cartridge 21 in the illustrative aspect.
Figure 8:
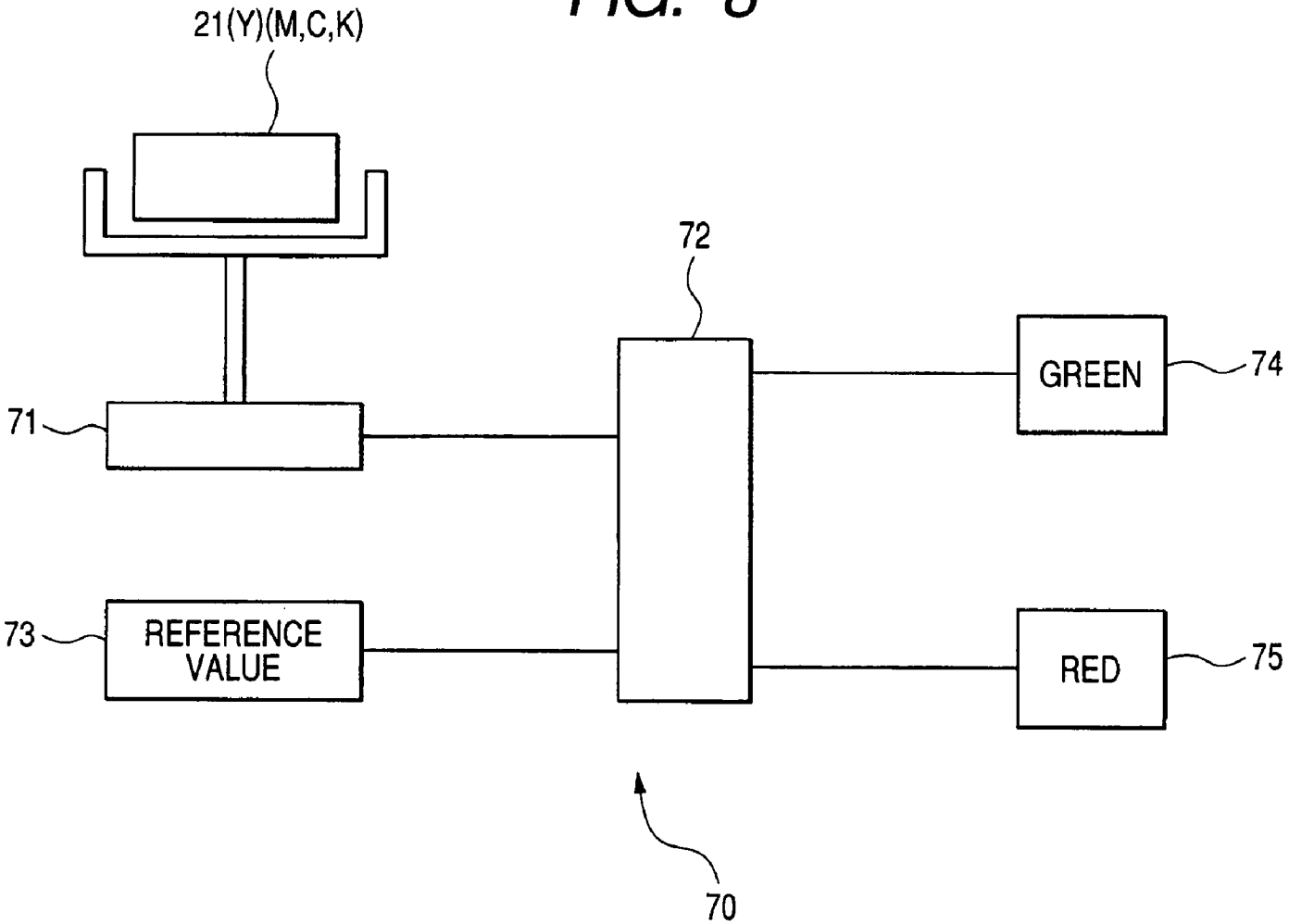
FIG. 8 is a conceptual diagram illustrating a determining device 70 used at the time of a determination process.
Figure 9:
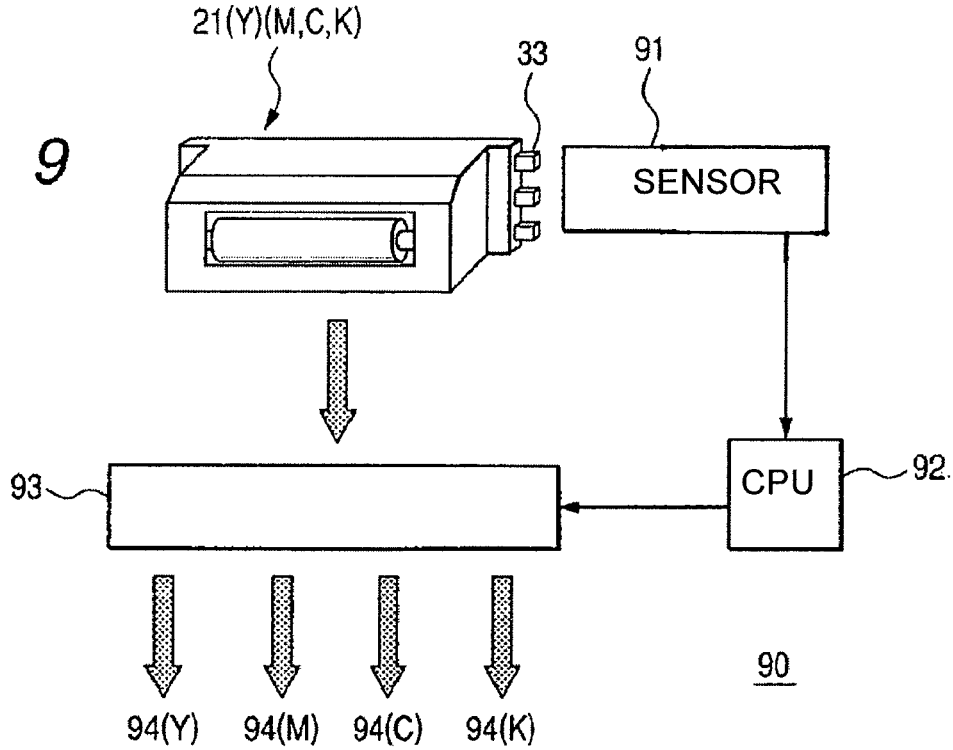
FIG. 9 is a conceptual diagram illustrating a carrying path switching mechanism 90 for switching a carrying path of a developer cartridge 21 by a color of a toner which is refilled in a developer cartridge 21.
Figure 10:
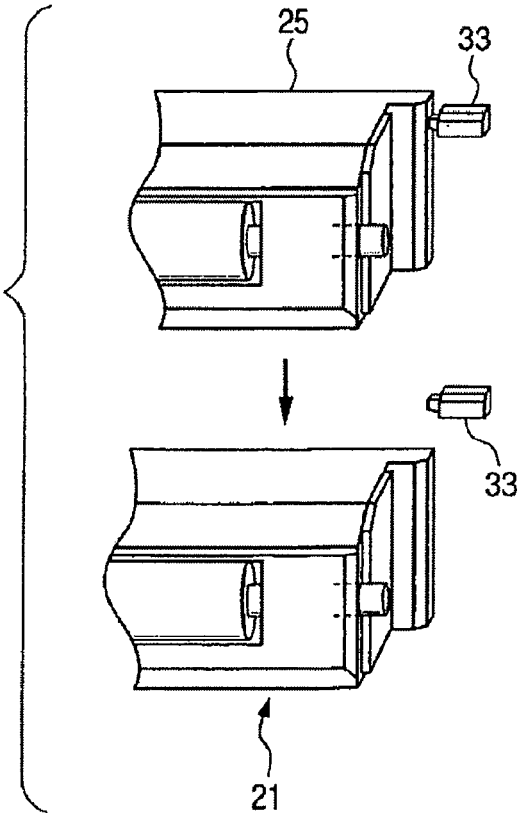
FIG. 10 is a perspective view illustrating two states before and after cutting a rib 33 provided on a side surface of a toner accommodating unit 25 of a development cartridge 21.

Next, a process of refilling of the developer cartridge 21 in which a new toner is refilled in the used developer cartridge 21 and the developer cartridge 21 is reused will be described with reference to FIGS. 5 to 9. FIG. 5 is a conceptual diagram illustrating a toner extraction mechanism 60 for extracting a residual toner in a toner accommodating unit 25 of a developer cartridge 21(Y) (M, C, and K). FIG. 6 is a conceptual diagram illustrating an extraction structure of a residual toner accommodated in a toner accommodating unit 25 of a developer cartridge 21(Y) (M, C, and K) by the toner extraction mechanism 60 according to an illustrative aspect. FIG. 7 is a flowchart illustrating a process of refilling a developer cartridge 21 according to a illustrative aspect. FIG. 8 is a conceptual diagram illustrating a determining device 70 used at the time of a determination process. FIG. 9 is a conceptual diagram illustrating a carrying path switching mechanism 90 for switching a carrying path of a developer cartridge 21 by a color of a toner which is refilled in a developer cartridge 21. FIG. 10 is a perspective view illustrating two states before and after cutting a rib 33 provided on a side surface of a toner accommodating unit 25 of a development cartridge 21(Y) (M, C, and K).

(Structure of Device Used in a Process of Refilling Developer Cartridge)

First, structures of devices used in a process of refilling the developer cartridge 21 will be described with FIGS. 5, 8, and 9. The devices used in the refilling process includes a toner extracting mechanism 60, a determining device 70, a carrying path switching mechanism 90, or the like, all of which will be described in detail below.

<Structure of Toner Extracting Mechanism>

As shown in FIG. 5, the toner extracting mechanism 60, which is used for extracting the residual toner, includes an intake pipe 61, a compressor 65, and a sucking mechanism 66. The intake pipe 61 has a sucking inlet 62, an air hose 63 which is mounted on the side surface of the intake pipe 61 and of which a front end has a claw shape, and an air outlet 64 that is provided at a front end of the air hose 63. The compressor 65 is connected to the air hose 63, and exhausts the air through the air outlet 64 under an air pressure of 5 kgf/m$^2$. The sucking mechanism 66 is connected to the intake pipe 61, and includes a sucking device 67 that sucks the toner from the sucking inlet 62, a toner storing room 68 that stores the toner sucked by the sucking device 67, and a filter 69 that separates the toner by the sucked air such that the toner sucked by the sucking device 67 or the toner stored in the toner storing room 68 does not enter the sucking device 67.

<Structure of Determining Device>

As shown in FIG. 8, the determining device 70 includes a weighing machine 71 that measures the weight of the residual toner in the toner accommodating unit 25 of the developer cartridge 21 on the basis of the weight of the developer cartridge 21, a comparator 72 that compares a reference value 73 with a measured value of the weight of the residual toner in the toner accommodating unit 25 measured by the weighing machine 71, a green lamp 74 that is driven by the comparator 72 and turned on with a green color when the measured value is not more than the reference value, and a red lamp 75 that is turned on with a red color when the measured value is greater than the reference value. Further, in the illustrative aspect, a numerical value of the reference value 73 is set to '17'.

<Structure of Carrying Path Switching Device>

As shown in FIG. 9, the carrying path switching device 90 includes a switching device 93 that switches a carrying path by the color of the toner which is originally filled in the developer cartridge 21, a sensor 91 that detects the number of the ribs 33 provided in the developer cartridge 21, and a CPU 92 that instructs the switching device 93 to switch the carrying path on the basis of the number of the ribs 33 detected by the sensor 91.

(Process of Refilling Developer Cartridge)

Next, a process of refilling a new toner of the developer cartridge 21 will be described with reference to FIGS. 4 to 9. In addition, the laser printer 1 according to the illustrative aspect includes the four developer cartridges 21. In addition, since all of the developer cartridges 21 are subjected to the same processes until it is determined what color is the toner originally filled in the developer cartridge 21 in a determining process (which will be described in detail below), the processes until now are described by using the yellow developer cartridge 21(Y).

First, the user opens the opening and closing cover 49 located at the front side of the laser printer 1, pulls out the developer cartridge 21(Y) in a horizontal direction while gripping the protruding portion 37 of the developer cartridge 21(Y) where little toner remains so as to remove the developer cartridge 21(Y) from the main body of the laser printer 1. The developer cartridge 21(Y), which has been removed from the main body of the laser printer 1, is collected in a factor so as to be recycled.

<Extracting Process>

By using the toner extracting mechanism 60, a process of extracting the residual toner in the developer cartridge 21 is performed with respect to the collected developer cartridge 21(Y). First, as shown in FIG. 4, since a toner filling opening 51 is provided in the side surface of the developer cartridge 21(Y), a cap 50, which is closing the toner filling opening 51, is opened. In addition, as shown in FIG. 6, the intake pipe 61 of the above-mentioned toner extracting mechanism 60 is inserted into the developer cartridge 21 through the toner filling opening 51, and the developer cartridge 21(Y) is inclined in an upward state in respect to the toner filling opening 51. Then, the compressor 65 and the sucking mechanism 66 are driven, blow off the toner 30 attached to the inside of the toner accommodating unit 25 in the developer cartridge 21(Y) by the air discharged from the air outlet 64 under an air pressure of 5 kgf/m$^2$ for 30 seconds, and suck the toner from the sucking inlet 62 for 30 seconds (S1). Moreover, when the toner is extracted, the intake pipe 61 is pulled in or rotates on the basis of the axis of the pipe 61 in a longitudinal direction, so that all of the surface of the toner accommodating unit 25 in the developer cartridge 21(Y), the feeder roller 26, the developer roller 27 or the like are exposed to the air. Therefore, it is possible to efficiently extract the toner.

<Measuring Process>

Next, by using the weighing machine 71 of the determining device 70 (see FIG. 8), the weight of the residual toner of the developer cartridge 21(Y) is measured with respect to the developer cartridge 21(Y), from which the toner is extracted in the extracting process (S1), on the basis of the weight of the developer cartridge 21(Y) including the ribs 33 (S2). Since a design value of the weight of the developer cartridge 21(Y) is set as a minus value in advance in the weighing machine 71, a value measured by putting the developer cartridge 21(Y) on the weighing machine 71 becomes the weight of the residual toner of the developer cartridge 21(Y). The tolerance between the design value of the weight of the developer cartridge 21 and the actual weight at the time of manufacturing the developer cartridge 21 is 1 g or less.

Moreover, the residual toner may also be attached to the feeder roller 26, the developer roller 27, the layer pressure regulating plate 28, and the agitator 36 each of which is a mechanism component disposed in the toner accommodating unit 25. The weight of these mechanism components is also measured by the weighing machine 71 together with the toner accommodating unit 25. In this manner, it is possible to save efforts for disassembling the developer cartridge 21(Y). In addition, since the weighing machine measures the weight of the residual toner including the mechanism components, it is possible to accurately measure the weight of the residual toner which does not affect a refilled toner. Therefore, it is possible to obtain an excellent image without cleaning the toner accommodating unit 25 of the developer cartridge 21(Y).

<Determining Process>

In the determining process, it is determined by the determining device 70 whether the weight of the residual toner is 17 g or less with respect to the developer cartridge 21(Y) in which the weight of the residual toner is measured in the measuring process (S2) (S3).

Figure 15:
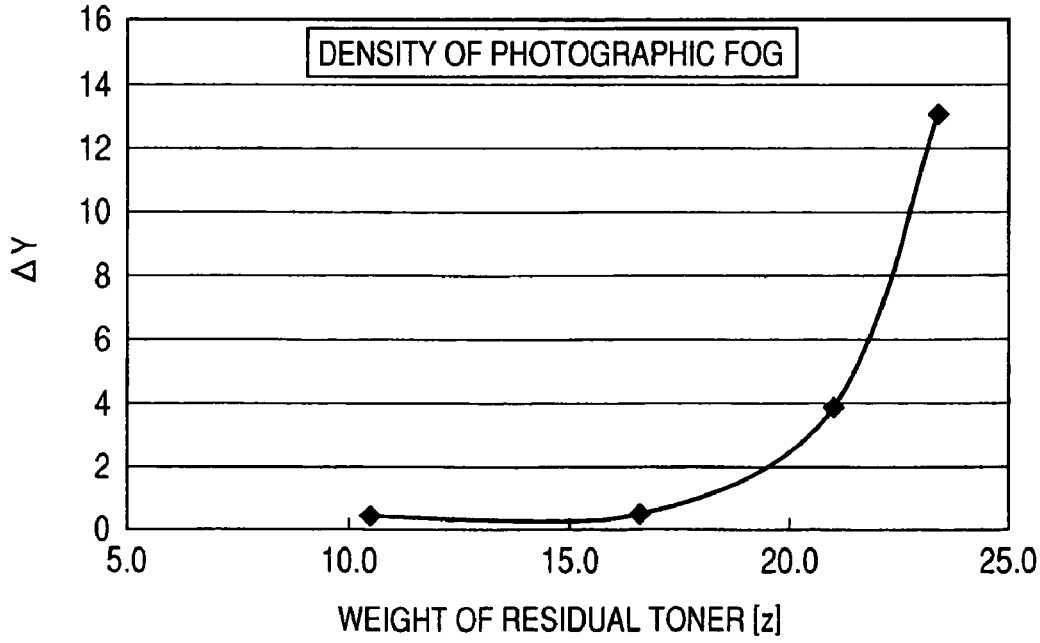
FIG. 15 illustrates a density of the photographic fog when the weight (g) is set to a horizontal axis and the difference (Δy) between the reference value of the photographic fog and the measured value of the photographic fog is set to a longitudinal axis.

When the measured value of the weight of the residual toner in the developer cartridge 21(Y) is greater than the reference value 73, a signal for instructing the red lamp 75 to be turned on is transmitted from the comparator 72 to the red lamp 75, and then the red lamp is turned on. When the red lamp 75 is turned on with a red color, that is, it is determined that the weight of the residual toner is greater than 17 g (S3: NO), the process returns to the extracting process (S1), the residual toner in the developer cartridge 21(Y) is extracted. Then, in the measuring process (S2), the weight of the residual toner is measured on the basis of the weight of the developer cartridge 21(Y). These processes are repeated until the weight of the residual toner is 17 g or less. Moreover, the threshold value, which is referred to as 17 g used as the determining reference, is calculated through the experiments. The experiment results are shown in Tables 1 to 3. Table 1 is a result obtained by performing a photographic fog returning test which evaluates the function when the white solid portion of the photosensitive belt 32 (a portion where characters, images or the like are not printed) are printed on ten sheets of paper 3. Table 2 is a result obtained by measuring a photographic fog of the photosensitive belt 32 right after one sheet of paper is printed. FIG. 15 is a graph illustrating the density of the photographic fog when the weight (g) of the residual toner is set to a horizontal axis and the difference ($\Delta$Y) between the reference value of the photographic fog and the measured value of the photographic fog is set to a longitudinal axis.

As shown in Table 1, the photographic fog returning test has been performed which evaluates the function when the white solid portion of the photosensitive belt 32 (a non-printed portion) are printed on ten sheets of paper 3. As such, the number of the printed paper where black spots do not exist was two or more when the weight of the residual toner is (1) 10.5 g, five or more when the weight of the residual toner is (2) 16.6 g, and seven to nine when the weight of the residual toner is (3) 21.0 g. However, when the number of the printer paper was ten or more, black spots of three or less were discovered, and black spots of four or more were discovered until ten sheets when the weight of the residual toner is (4) 23.4 g, and the photographic fog returning process cannot be performed.

Further, as shown in Table 2, if the photographic fog of the photosensitive belt 32 is measured right after one sheet of paper is printed, the photographic fog of the photosensitive belt 32 was 0.4 when the weight of the residual toner is (1) 10.5 g, was 0.48 when the weight of the residual toner is (2) 16.6 g, was 3.86 when the weight of the residual toner is 21.0 g, and was 13.11 g when the weight of the residual toner is 23.4 g. As shown in FIG. 15, the times when the photographic fog is lower than a red line (Δy=1) indicating an allowable limit for supplying a high definition image correspond to the time when the weight of the residual toner was (1) 10.5 g and a time when the weight of the residual toner was (2) 16.6 g.

From the above-mentioned experimental results, the weight of the residual toner in a case in which a result obtained by evaluating the function when the white solid portion of the photosensitive belt 32 are printed on ten sheets of paper 3 is 'O (black spots do not exist)' or 'Δ (black spots are less than four)' is assumed as the weight, which does not affect the printing, for obtaining a high definition image, the weight 16.6 g of the residual toner in the (2) experiment of Table 1 is rounded off to the nearest whole number down to one decimal place, and an upper limit is set to 17 g. Thereby, it can be consistently determined in the determining process (S3) whether the conditions are satisfied, and it can be accurately determined whether the developer cartridge 21(Y) has entered a state in which a new toner can be refilled. Moreover, preferably, the upper limit of the weight of the residual toner, which does not affect the printing, for obtaining the high definition image is a value obtained by rounding 13.55 g, which is a middle value between the weight of the residual toner of the (1) 10.5 g and the weight of the residual toner of the (2) 16.6 g, off to the nearest whole number down to one decimal place, that is, 14 g.

TABLE 1

| | weight of residual toner (g) | first sheet of paper | second sheet of paper | third sheet of paper | fourth sheet of paper | fifth sheet of paper |
|---|---|---|---|---|---|---|
| (1) | 10.5 | Δ | ○ | ○ | ○ | ○ |
| (2) | 16.6 | Δ | Δ | Δ | Δ | ○ |
| (3) | 21.0 | X | ○ | ○ | X | Δ |
| (4) | 23.4 | X | X | X | X | X |

| | weight of residual toner (g) | sixth sheet of paper | seventh sheet of paper | eighth sheet of paper | ninth sheet of paper | tenth sheet of paper |
|---|---|---|---|---|---|---|
| (1) | 10.5 | ○ | ○ | ○ | ○ | ○ |
| (2) | 16.6 | ○ | ○ | ○ | ○ | ○ |
| (3) | 21.0 | Δ | ○ | ○ | ○ | Δ |
| (4) | 23.4 | X | X | X | X | X |

Table 1 illustrates the result obtained by performing the photographic fog returning experiment which evaluates the function when the white solid portion of the photosensitive belt 32 (a non-printed portion) is printed on the ten sheets of paper 3. A symbol 'O' indicates that the black spots do not exist, a symbol 'Δ' indicates an intermediate state between 'O' and 'x', and a symbol 'x' indicates that black spots having a diameter of 1 mm or more or black spots having a diameter less than 1 mm are four or more.

TABLE 2

| | weight of residual toner (g) | difference between reference value of photographic fog and measured value of photographic fog (Δy) | reference value of photographic fog | measured value of photographic fog |
|---|---|---|---|---|
| (1) | 10.5 | 0.4 | 82.12 | 81.72 |
| (2) | 16.6 | 0.48 | 82.12 | 81.64 |
| (3) | 21.0 | 3.86 | 82.12 | 78.3 |
| (4) | 23.4 | 13.11 | 82.12 | 69.01 |

Table 2 illustrates the result obtained by measuring the photographic fog of the photosensitive belt 32 after one sheet of paper is printed.

In this case, FIG. 15 illustrates the density of the photographic fog when the weight (g) is set to a horizontal axis and the difference (Δy) between the reference value of the photographic fog and the measured value of the photographic fog is set to a longitudinal axis.

When the measured value of the weight of the residual toner in the developer cartridge 21(Y) is not more than the reference value 73, a signal for instructing the green lamp 74 to be turned on is transmitted from the comparator 72 to the green lamp 74, and then the green lamp 74 is turned on. When the green lamp 74 is turned on with a green color, that is, it is determined that the weight of the residual toner is not more than 17 g (S3:Yes), it is determined in a determining process what color is the toner originally filled in the developer cartridge 21(Y) (S4). As described above, since the number of the ribs 33 provided in the developer cartridge 21 is different by the color of the toner originally filled in the developer cartridge 21, the number of the ribs can be determined.

<Filling Process>

In the flowchart of FIG. 7, since all of the four developer cartridges 21 follow the different flow by the carrying path switching mechanism 90 after the filling process (S5), the respective cases of the four developer cartridges 21(Y), 21(M), 21(C), and 21(K) will be described with reference to FIGS. 7 to 9.

In the determining process (S4), the number of the ribs 33 in the developer cartridge 21 is determined by the sensor 91. In addition, when it is determined by the CPU 92 that the developer cartridge 21 is originally the black developer cartridge 21(K) and filled with the black toner (S4:K), the CPU 92 transmits the determined result to the switching device 93. The switching device 93 that receives the determined result switches the carrying path to the black toner filling path 94(K). In addition, the black toner filling path 94(K) is carried to the black developer cartridge 21(K), and the black toner cartridge 21(K) is refilled with black toner (S5). The black developer cartridge 21(K) in which the new black toner is refilled is subjected to a test for determining whether a failure exists or does not exist (S6), and then packaged and shipped (S7). In this manner, the refilling process of the collected black developer cartridge 21(K) is completed.

In the determining process (S4), the number of the ribs 33 in the developer cartridge 21 is determined by the sensor 91. In addition, when it is determined by the CPU 92 that the developer cartridge 21 is originally the cyan developer cartridge 21(C) and filled with the cyan toner (S4:C), the CPU 92 transmits the determined result to the switching device 93. The switching device 93 that receives the determined result switches the carrying path to the cyan toner filling path 94(C) or the black toner filling path 94(K). In addition, the cyan toner filling path 94(C) or the black toner filling path 94(K) is carried to the cyan developer cartridge 21(C), and the cyan toner cartridge 21(C) is refilled with the cyan toner or the black toner darker than the cyan toner (S8). If the new toner refilled in the developer cartridge 21(C) is a cyan toner, the one rib 33 provided in the developer cartridge 21(C) remains as it is (S9), and the cyan developer cartridge 21(C) is subjected to a test for determining whether a failure exists or does not exist (S10). The developer cartridge 21(C) is packaged and shipped as the cyan developer cartridge 21(C) (S11). In addition, if the new toner refilled in the developer cartridge 21(C) is the black toner, as shown in FIG. 10, one rib 33 is cut, and the developer cartridge 21(C) enters a state in which the rib 33 does not exist (S9). In addition, the developer cartridge 21(C) having cut one rib 33 is subjected to a test for determining whether a failure exists or does not exist (S10) and then packed and shipped as the black developer cartridge 21(K) (S1). In this manner, the process of refilling the collected cyan developer cartridge 21(C) is completed.

In the determining process (S4), the number of the ribs 33 in the developer cartridge 21 is determined by the sensor 91. In addition, when it is determined by the CPU 92 that the developer cartridge 21 is originally the magenta developer cartridge 21(M) and filled with the magenta toner (S4:M), the CPU 92 transmits the determined result to the switching device 93. The switching device 93 that receives the determined result switches the carrying path to any one of the magenta toner filling path 94(M), the cyan toner filling path 94(C), and the black toner filling path 94(K). In addition, the magenta toner filling path 94(M), the cyan toner filling path 94(C) or the black toner filling path 94(K) is carried to the magenta developer cartridge 21(M), and the magenta toner cartridge 21(M) is refilled with any one of the magenta toner, the cyan toner darker than the magenta toner, and the black toner (S12). If the new toner refilled in the developer cartridge 21(M) is a magenta toner, the two ribs 33 provided in the developer cartridge 21(M) remain as they are (S13), and the magenta developer cartridge 21(M) is subjected to a test for determining whether a failure exists or does not exist (S14). The developer cartridge is packaged and shipped as the magenta developer cartridge 21(M) (S15). In addition, if the new toner refilled in the developer cartridge 21(M) is the cyan toner, one rib 33 is cut, and the developer cartridge 21(M) enters a state in which the one rib 33 is provided (S13). In addition, the developer cartridge 21(M) having cut one rib 33 is subjected to a test for determining whether a failure exists or does not exist (S14) and then packaged and shipped as the cyan developer cartridge 21(C) (S15). If the new toner refilled in the developer cartridge 21(M) is the black toner, two ribs 33 are cut, and the developer cartridge 21(M) enters a state in which the rib 33 does not exist (S13). In addition, the developer cartridge 21(M) having cut the two ribs 33 is subjected to a test for determining whether a failure exists or does not exist (S14) and then packed and shipped as the black developer cartridge 21(K) (S15). In this manner, the process of refilling the collected cyan developer cartridge 21(M) is completed.

In the determining process (S4), the number of the ribs 33 in the developer cartridge 21 is determined by the sensor 91. In addition, when it is determined by the CPU 92 that the developer cartridge 21 is originally the yellow developer cartridge 21(Y) and filled with the yellow toner (S4:Y), the CPU 92 transmits the determined result to the switching device 93. The switching device 93 that receives the determined result switches the carrying path to any one of the yellow toner filling path 94(Y), the magenta toner filling path 94(M), the cyan toner filling path 94(C), and the yellow toner filling path 94(K). In addition, the yellow toner filling path 94(Y), the magenta toner filling path 94(M), the cyan toner filling path 94(C), or the black toner filling path 94(K) is carried to the yellow developer cartridge 21(Y), and the yellow toner cartridge 21(Y) is refilled with any one of the yellow toner, the magenta toner, the magenta toner darker than the yellow toner, the cyan toner, and the black toner (S16). If the new toner refilled in the developer cartridge 21(Y) is a yellow toner, the three ribs 33 provided in the developer cartridge 21(Y) remain as they are (S17), and the yellow developer cartridge 21(Y) is subjected to a test for determining whether a failure exists or does not exist (S18). The developer cartridge is packaged and shipped as the yellow developer cartridge 21(Y) (S19). In addition, if the new toner refilled in the developer cartridge 21(Y) is the magenta toner, one rib 33 is cut, and the developer cartridge 21(Y) enters a state in which the two ribs 22 are provided (S17). In addition, the developer cartridge 21(Y) having cut one rib 33 is subjected to a test for determining whether a failure exists or does not exist (S18) and then packaged and shipped as the magenta developer cartridge 21(M) (S19). If the new toner refilled in the developer cartridge 21(Y) is the cyan toner, two ribs 33 are cut, and the developer cartridge 21(Y) enters a state in which one rib 33 is provided (S17). In addition, the developer cartridge 21(Y) having cut the two ribs 33 is subjected to a test for determining whether a failure exists or does not exist (S18) and then packaged and shipped as the cyan developer cartridge 21(C) (S19). In addition, if the new toner refilled in the developer cartridge 21(Y) is the black toner, three ribs 33 are cut, and the developer cartridge 21(Y) enters a state in which the rib 33 does not exist (S17). In addition, the developer cartridge 21(Y) having cut the three ribs 33 is subjected to a test for determining whether a failure exists or does not exist (S18) and then packed and shipped as the black developer cartridge 21(K) (S19). In this manner, the process of refilling the collected yellow developer cartridge 21(Y) is completed.

As such, after the residual old toner in the toner accommodating unit 5 is simply extracted, if the weight of the residual toner is not more than a predetermined value and a new toner having the same color as the old toner or darker than the old toner is refilled in the toner accommodating unit, the feeder roller 26, the developer roller 27, the layer pressure regulating plate 28, and the agitator 36, each of which serves as a mechanism component, are built in toner cartridge, so that the structure of the inside of the toner accommodating unit 25 of the toner cartridge 21 is complicated, which it is difficult to perform a cleaning process. However, even in this case, a cleaning process does not need to be performed until the residual toner in the toner accommodating unit 25 is completely removed, so that a time or effort is not wasted. In addition, since the residual old toner originally filled in the developer cartridge 21 does not affect the newly refilled toner, the charged amount of the refilled toner can be maintained, and an excellent image quality can be obtained. Further, since a polymerization toner has superior fluidity, it is possible to further reduce the residual toner.

Moreover, when the black developer cartridge 21(K) reaches the carrying path switching mechanism 90, the switching device 93 may switch the carrying path to only the black toner filling path 94(K), but when the developer cartridges 21(Y, M, and C) other than the black developer cartridge 21(K) reach the carrying path switching mechanism 90, one switched carrying path should be selected from a plurality of carrying paths. That is, only one color of the refilled toner should be selected. At this time, a method of selecting the color of the refilled toner is as follows.

According to a first method, generally, the toner having the same color as the toner which is originally filled in the developer cartridge 21 is refilled. In a case in which of the developer cartridges 21 corresponding to the colors of the refilled toners, a toner 21 having a numerical value smaller than a predetermined value exists, a color of the toner cartridge 21 having a numerical value smaller than the predetermined value is refilled.

According to a second method, the number of times reused in the developer cartridge 21 is displayed on the developer cartridge 21. At this time, if the toner having the same color as the toner originally filled in the developer cartridge 21 is filled twice, the color which is one level darker than the color of the previously filled toner is refilled twice in the following processes.

According to a third method, the toner is refilled such that the ratios of the numerical values of the developer cartridges 21 of the respective colors shipped again after performing the refilling process are equal or the ratio of the numerical value of the developer cartridge 21 of the mainly used color is large on the basis of the ratios of the developer cartridges 21 of the respective collected colors.

As such, the developer cartridge 21 to which the toner filling path 94 is carried and which is shipped via the filling process is mounted again in the process accommodating member 20 of the laser printer 1. In addition, the developer cartridge 21 whose toner is consumed by the printing of the laser printer 1 is collected again, and the refilling process is performed. Moreover, since it is assumed that a lot of developer cartridges 21 are collected, the developer cartridges 21 may be carried using a belt conveyer in each process.

[Another Illustrative Aspect]

Figure 11:
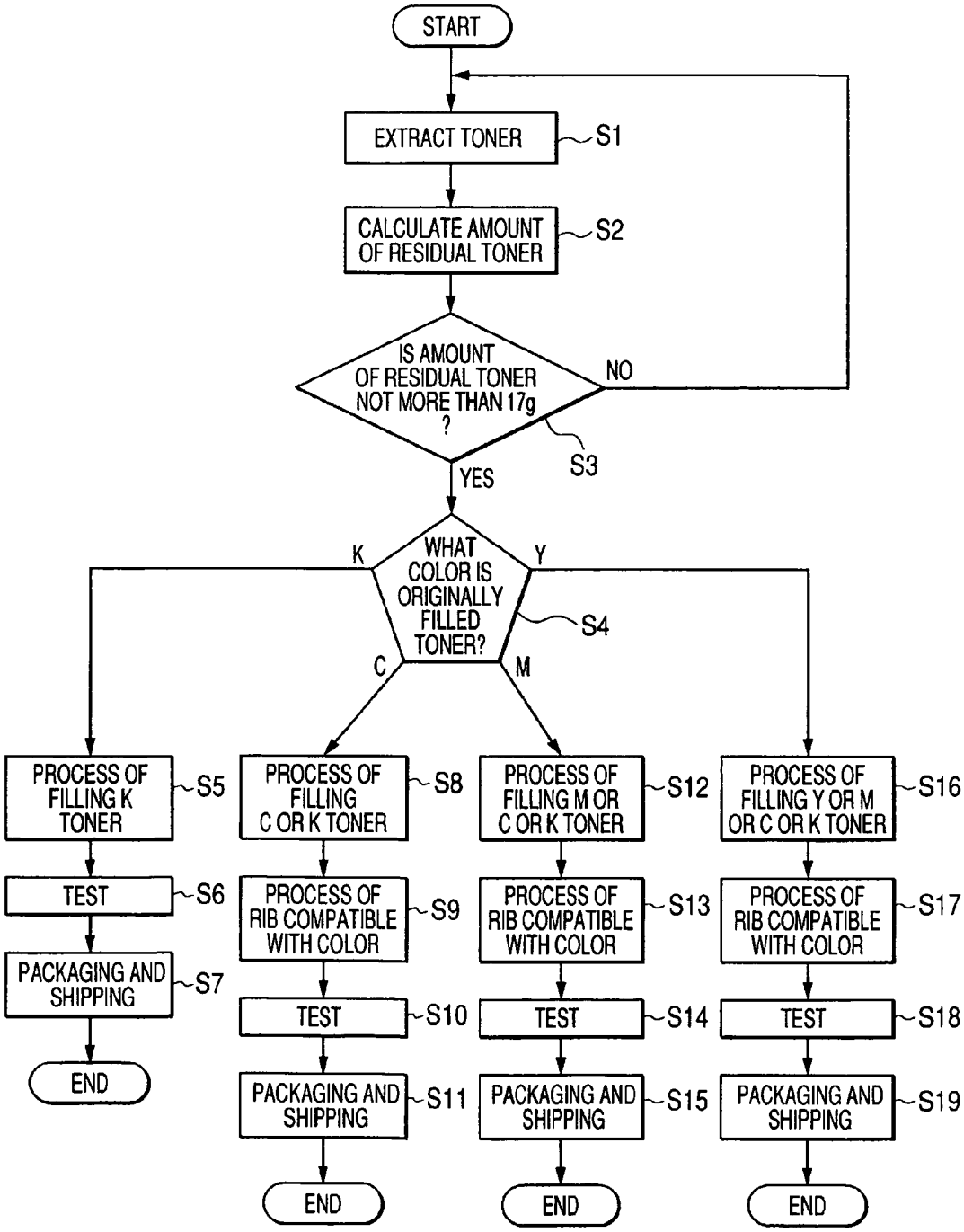
FIG. 11 is a flowchart illustrating a process of refilling a developer cartridge 21 in another illustrative aspect.

A color laser printer 1 according to an illustrative aspect, which includes four developer cartridges 21(Y), 21(M), 21(C), and 21(K), will be described in detail with reference to FIG. 11. In addition, constituent elements which correspond to those of the above-illustrative aspect are denoted by the same reference numeral, and the description overlapping the above-illustrative aspect will be omitted. FIG. 11 is a flowchart illustrating a process of refilling the developer cartridge 21 in the illustrative aspect.

(Process of Refilling Developer Cartridge)

In the process of refilling the developer cartridge 21 according to the above-illustrative aspect, the measuring process (S2) is performed after performing the extracting process (S1), but in the process of refilling the developer cartridge 21 according to the illustrative aspect, the measuring process is performed prior to the extracting process.

<Measuring Process>

First, the weight of the residual toner in the developer cartridge 21 is measured with respect to the collected developer cartridge 21 on the basis of the weight of the developer cartridge 21 (S1').

<Determining Process>

In the determining process, it is determined whether the weight of the residual toner measured in the measuring process (S1') is 17 g or less.

<Extracting Process>

If it is determined that the weight of the residual toner is greater than 17 g (S2': NO), the process of extracting the residual toner in the developer cartridge 21 is performed (S3'). With respect to the developer cartridge 21 in which the toner is extracted in the extracting process (S3'), the process returns to the measuring process (S1') again, and the weight of the residual toner is measured on the basis of the weight of the developer cartridge 21. These processes are repeated until the weight of the residual toner is not more than 17 g.

<Filling Process>

If it is determined that the weight of the residual toner is not more than 17 g (S2':YES), similar to the above-illustrative aspect, the process is performed from the determining process (S4) for determining what color is the toner originally filled in the developer cartridge 21 to the processes of packaging and shipping the developer cartridge 21 (S7, S11, S15, and S19).

In future, when using the toner which is difficult to remain in the developer cartridge 21, if the weight of the residual toner is not more than 17 g, as in the illustrative aspect, the measuring process is first performed while omitting the extracting process, so that it is possible to reduce the time or effort necessary for refilling the developer cartridge 21.

<Modification>

The above-illustrative aspects have been described, but the illustrative aspect is not limited thereto, and various changes and modifications can be made without departing from the technical scope.

Figure 12:
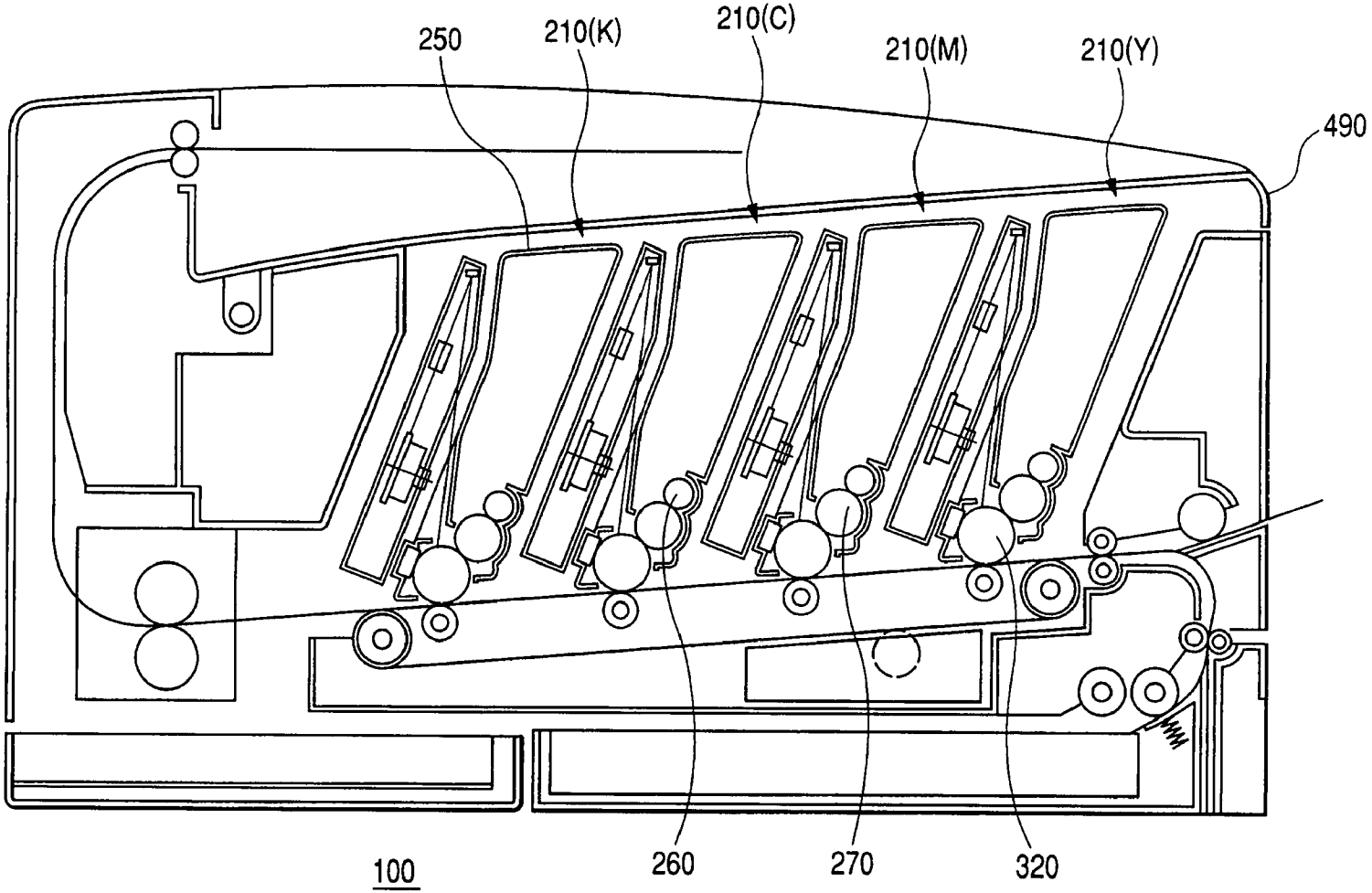
FIG. 12 is a lateral cross-sectional view illustrating a main portion of a color laser printer 100 according to a modification.

For example, the illustrative aspects are not limited to only the structure of the laser printer 1. In the laser printer 1 according to the above-mentioned illustrative aspect, the plurality of developer cartridges 21 are disposed in a vertical direction, the image is transferred to the intermediate transfer belt 45 after being formed on the photosensitive belt 32, and the image is finally transferred to the paper 3. The user opens the opening and closing cover 49 provided on the front surface of the laser printer 1, and the developer cartridge 21 is attached or detached in a horizontal direction. However, the laser printer 100 shown in FIG. 12 has a so-called horizontal-type direct tandem structure in which the four developer cartridges (210(Y), 210(M), 210(C), and 210(K)) are disposed in a horizontal direction, and the image is directly transferred to the paper 300 after the image is formed on the photosensitive drum 320. Using the laser printer 100, even if the user opens the opening and closing cover 490 provided on the top surface of the laser printer 100 and the developer cartridge 21 is attached or detached in a vertical direction, the method of refilling the developer cartridge according to the above-illustrative aspects can be applied.

In addition, as the mechanism components built in the developer cartridge 210, in addition to the feeder roller 260, the developer roller 270, or the like, the photosensitive drum 320 may be built in the developer cartridge 210.

In order to determine the color of the toner filled in the developer cartridge 21 or 210, the ribs 33 are provided. At the time of cutting the ribs 33 shown in FIG. 10, a tool may be provided which displays the color of the newly refilled toner. In this manner, it is possible to quickly determine the color of the toner.

With respect to the color refilled in the developer cartridge 21 or 210, when the color of the originally filled toner is one of magenta and cyan, the black toner may be refilled. When only the minute difference exists between the density of the magenta and the density of the cyan, if the toner of the other color is refilled in the developer cartridge 21 in which the color of the originally filled toner is one of magenta and cyan, even though the weight of the residual toner of the one of magenta and cyan is not more than 17 g, the toner of the other color may easily affect the residual toner of the one color, and the refilled toner of the other color may be deteriorated. However, as described above, if the black toner is refilled, it is possible to prevent the above-mentioned problem from occurring.

Figure 13:
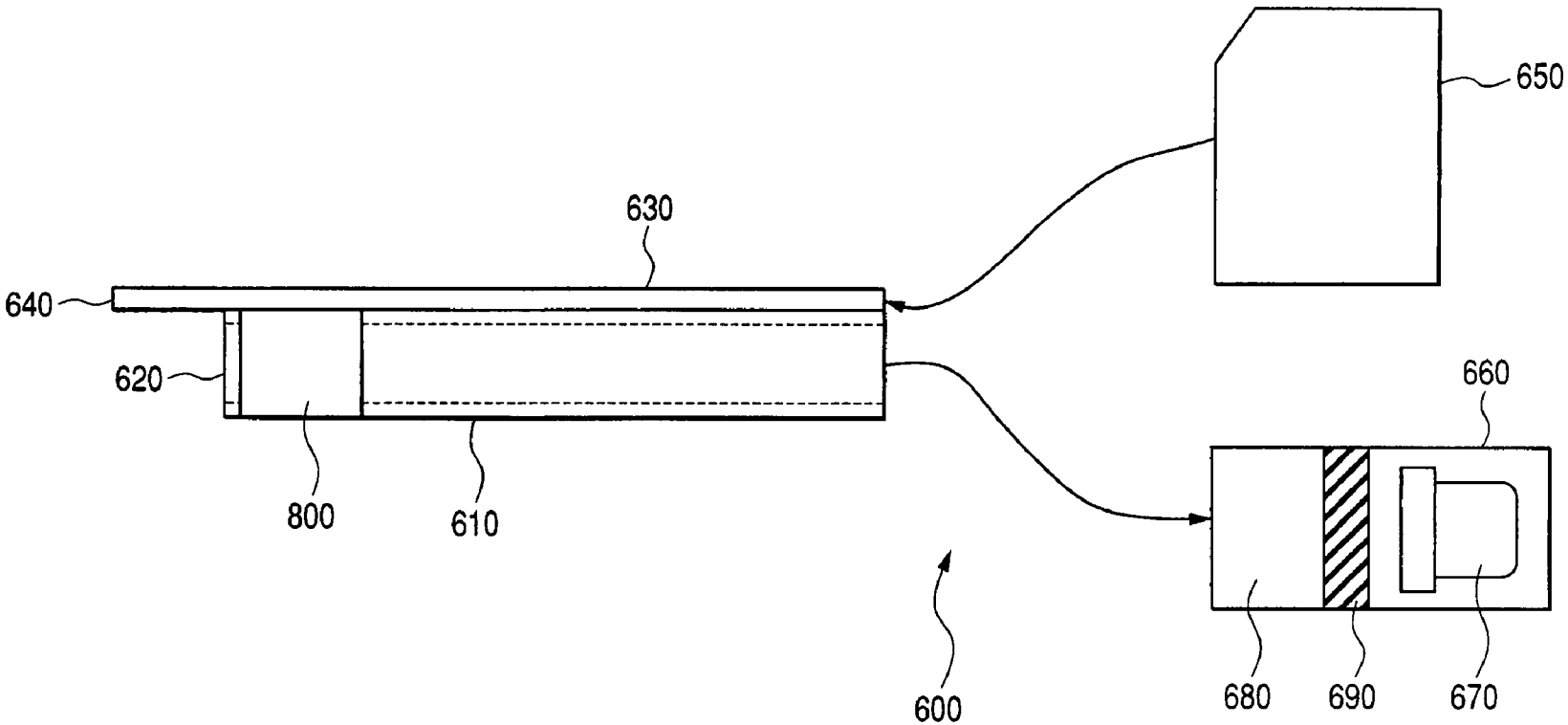
FIG. 13 is a conceptual diagram illustrating a toner extraction mechanism 600 for extracting a residual toner in a developer cartridge 21.
Figure 14:
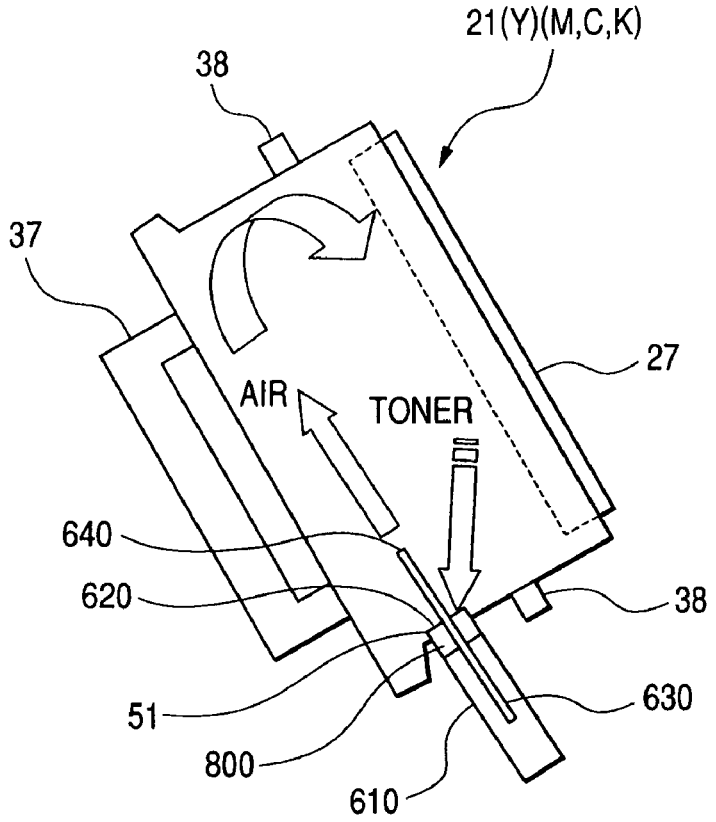
FIG. 14 is a conceptual diagram illustrating an extraction structure of a residual toner in a developer cartridge 21 by a toner extracting mechanism 600.

Further, various changes and modifications can be made in the method of extracting the residual toner in the developer cartridge 21 in the extracting process. FIG. 13 is a conceptual diagram illustrating a toner extraction mechanism 600 for extracting a residual toner in a developer cartridge 21. FIG. 14 is a conceptual diagram illustrating an extraction structure of a residual toner in a developer cartridge 21 by a toner extracting mechanism 600.

As shown in FIG. 13, the toner extracting mechanism 600 includes an intake pipe 610, a compressor 650, and a sucking device 670. The intake pipe 610 has a sucking inlet 620, a linear air hose 630 which is mounted on the side surface of the intake pipe 610 and protrudes more than the sucking inlet 620, and an air outlet 640 that is provided at a front end of the air hose 630. Similar to the above-illustrative aspect, the compressor 650 is connected to the air hose 630, and exhausts the air from the air outlet 640. The sucking mechanism 660 includes a sucking device 670 that sucks the toner from the sucking inlet 620, a toner storing chamber 680 that stores the toner sucked by the sucking device 670, and a filter 690 that separates the toner by the sucked air such that the toner sucked by the sucking device 670 or the toner stored in the toner storing chamber 680 does not enter the sucking device 670.

By the above-mentioned toner extracting mechanism 600, a process of extracting the residual toner in the developer cartridge 21 is performed. First, as shown in FIG. 4, a cap 50 is opened. In addition, as shown in FIG. 14, the intake pipe 610 of the above-mentioned toner extracting mechanism 600 is inserted into the developer cartridge 21 through the toner filling opening 51, and the developer cartridge 21 is inclined in a downward state in respect to the toner filling opening 51. Then, the compressor 650 and the sucking mechanism 660 are driven, blow off the toner 30 attached to the inside of the toner accommodating unit 25 in the developer cartridge 21 by the air discharged from the air outlet 64 under an air pressure of 5 kgf/m$^2$ for 30 seconds, and suck the toner 30 through the sucking inlet 620 for 30 seconds. Moreover, in order to prevent the dropped toner from falling from the gap between the sucking inlet 620 and the toner filling opening 51, the front end portion of the intake pipe 610 at the side inserted in the developer cartridge 21 is made of an elastic member 800, such as a sponge or rubber, or is covered with the elastic member 800, so that the elastic member 800 may cover the toner filling opening 51.

When it is determined that the measured value is greater than the predetermined value, the extraction and the measuremtn may be sequentially performed in plural times.

According the above-illustrative aspects, the residual developer is extracted from the container, when it is determined that the measured value is greater than the predetermined value. Further, after the residual developer is extracted, the extraction and the measurement are sequentially performed in plural times.

According to the above-illustrative aspects, the developer may be manufactured by a polymerization method.

According to the above-illustrative aspects, the weight of the residual developer in the container is measured on the basis of the total weight including the container and mechanism components disposed in the container.

According to the above-illustrative aspects, the container may comprise a display unit that displays a color of the developer contained in the container. A color of a newly refilled developer is determined on the basis of the color displayed by the display unit.

According to the above-illustrative aspects, the predetermined value may be 17 g.

According to the above-illustrative aspects, a number of the ribs decreases when a color of the new developer refilled in the container becomes darker.

According to the above-illustrative aspects, even if the developer contained in the container before the developer refilled in the container remains, the original developer does not affect the refilled developer.

Accordingly, it is possible to obtain an excellent image without cleaning the container. Further, since the developer is manufactured by the polymerization method, excellent fluidity of the polymerization developer can be achieved, so that the developer can be simply extracted, thereby further reducing the residual amount of the used developer. Furthermore, since the effort for cleaning the container can be saved, the refilling process can be easily performed.

According to the above-illustrative aspects, even when the developer contained in the container before the developer filled in the filling process remains, if the amount of the developer is not more than a predetermined value, it does not affect the refilled developer. Therefore, it is possible to obtain a quality excellent image without cleaning the container. Furthermore, since the effort for cleaning the container can be saved, the refilling process can be easily performed.

According to the above-illustrative aspects, even if the developer having the weight greater than the predetermined value remains in the container of the developer cartridge, since the extraction process is repeatedly performed until the weight of the developer is not more than the predetermined value, it is possible to prevent the refilled developer from being affected by the residual developer. Therefore, it is possible to obtain a quality excellent image without cleaning the container.

According to the above-illustrative aspects, even though the original developer contained in the container before the new developer refilled in the filling process remains in the container, if the amount of the residual original toner is not more than the predetermined value, the residual original toner does not affect the refilled developer. Accordingly, it is possible to obtain a quality excellent image without cleaning the container. Further, since the effort for cleaning the container can be saved, the refilling process can be easily performed. Furthermore, when the toner remains in the container after being used for forming an image and it is determined that the weight of the developer measured is not more than the predetermined value, the extraction is omitted, and the process proceeds to the filling process. Therefore, it is possible to reduce the time needed for refilling the developer.

According to the above-illustrative aspects, the developer having the weight greater than the predetermined value remains in the container of the developer cartridge, since the extraction process is repeatedly performed until the weight of the developer is not more than the predetermined value, it is possible to prevent the refilled developer from being affected by the residual developer. Therefore, it is possible to obtain a quality excellent image without cleaning the container.

According to the above-illustrative aspects, since excellent fluidity of the polymerization developer can be obtained, the developer can be simply extracted, so that it is possible to further reduce the residual amount of the used developer. Further, since the effort for cleaning the container can be saved, the refilling process can be easily performed.

According to the above-illustrative aspects, the effort for disassembling the developer cartridge can be saved. In addition, the residual developer may be attached to the mechanism components. However, the weight of the residual developer in the container is measured on the basis of the total weight including the mechanism components, so that it is possible to accurately measure the weight of the residual toner which does not affect the refilled developer. Therefore, it is possible to obtain a quality excellent image without cleaning the container of the developer cartridge. Furthermore, since the effort for cleaning the container can be saved, the refilling process can be easily performed.

According to the above-illustrative aspects, it is possible to determine the color in the developer contained in the container of the developer cartridge, and it is possible to prevent the developer having the different color from the desired color from being refilled in the container.

According to the above-illustrative aspects, since the determining process can be consistently performed, it is possible to accurately determine whether the developer needs to be refilled or not refilled.

According to the above-illustrative aspects, even though the developer remains in the container, if the weight of the residual developer is not more than the predetermined value, the residual developer does not affect the refilled developer. Therefore, it is possible to obtain a quality excellent image without cleaning the container. Further, since excellent fluidity of the polymerization developer can be obtained, the developer can be simply extracted, so that it is possible to further reduce the residual amount of the used developer. Furthermore, since the effort for cleaning the container can be saved, the refilling process can be easily performed.

According to the above-illustrative aspects, the color of the developer in the developer cartridge can be determined by only confirming the number of the ribs. Further, even though the color of the developer varies whenever the developer is refilled in the developer cartridge, only the ribs may be cut, so that workability can be improved.

According to the above-illustrative aspects, even though the plurality of developer cartridges exist, the respective developer cartridges can be mounted on portions corresponding to predetermined positions of the image forming apparatus without an error.

What is claimed is:

1. A method of refilling a developer cartridge, comprising:

measuring a weight of a residual developer in a container on the basis of a weight of a developer cartridge that contains a developer;

determining whether a value of the measured weight of the residual developer is not more than a predetermined value; and refilling, when it is determined that the value is not more than the predetermined value, a new developer comprising the same color as the original developer or a color darker than the color of the original developer in the container.

2. The method of refilling a developer cartridge according to claim 1, further comprising:

extracting the residual developer from the container, when it is determined that the value is greater than the predetermined value; and sequentially performing the extraction of the residual developer and the measurement of the weight of the residual developer in plural times after the residual developer is extracted.

3. A method of refilling a developer cartridge, comprising:

extracting a residual developer from a container that contains a developer;

measuring a weight of the residual developer in the container on the basis of a weight of a developer cartridge obtained after extracting the residual developer;

determining whether a value of the measured weight of the residual developer is not more than a predetermined value; and refilling, when it is determined that the value is not more than the predetermined value, a new developer comprising the same color as the original developer or a color darker than the color of the original developer in the container.

4. The method of refilling a developer cartridge according to claim 3, further comprising:

sequentially performing the extraction of the residual developer and the measurement of the weight of the residual developer in plural times when it is determined that the value is greater than the predetermined value.

5. The method of refilling a developer cartridge according to claim 3, wherein the developer is manufactured by a polymerization method.

6. The method of refilling a developer cartridge according to claim 3, further comprising:

measuring the weight of the residual developer in the container on the basis of a total weight including the container and a mechanism component disposed in the container when the weight of the residual developer in the container is measured.

7. The method of refilling a developer cartridge according to claim 3, further comprising:

determining a color of a newly refilled developer on the basis of a color of the developer displayed by a display unit included in the container when the new developer is refilled.

8. The method of refilling a developer cartridge according to claim 3, further comprising:

setting a predetermined value in 17 g when whether the value is not more than the predetermined value is determined.

9. A developer cartridge comprising:

a container in which a developer manufactured by a polymerization method is contained; and a rib comprising the same shape as a main body of an image forming apparatus contained in the container, wherein a new developer manufactured by a polymerization method is refilled in the container when an amount of developer is not more than a predetermined value, wherein the new developer comprises the same color as an original developer or a color darker than the color of the original developer, and wherein a number of the rib varies in accordance with a color of the developer refilled in the container.

10. The developer cartridge according to claim 9, wherein the number of the rib decreases when a color of the new developer refilled in the container becomes darker.

11. An image forming apparatus comprising:

a frame that comprises a plurality of developer cartridges according to claim 9 provided so as to be attached to or detached from the frame; and a groove being provided in the frame, and the groove corresponds to the rib respectively provided in the container of the plurality of developer cartridges.

* * * * *